US006881176B2

(12) United States Patent
Oishi et al.

(10) Patent No.: US 6,881,176 B2
(45) Date of Patent: Apr. 19, 2005

(54) EXERCISE ASSISTANCE APPARATUS

(75) Inventors: Toshimitsu Oishi, Akashi (JP); Shin Terao, Kobe (JP); Takeaki Hayashino, Kobe (JP); Yurina Oguchi, Kobe (JP); Yasuhiro Shitan, Setagaya-ku (JP)

(73) Assignee: Konami Sports Life Corporation, Tokyo (JP)

( * ) Notice: Subject to any disclaimer, the term of this patent is extended or adjusted under 35 U.S.C. 154(b) by 66 days.

(21) Appl. No.: 10/328,552

(22) Filed: Dec. 23, 2002

(65) Prior Publication Data

US 2003/0134714 A1 Jul. 17, 2003

(30) Foreign Application Priority Data

Jan. 11, 2002 (JP) ..... 2002/004679

(51) Int. Cl.[7] ..... A63B 21/00
(52) U.S. Cl. ..... 482/8; 482/7; 482/900
(58) Field of Search ..... 482/1–9, 51, 900–902

(56) References Cited

U.S. PATENT DOCUMENTS

| | | | | |
|---|---|---|---|---|
| 4,542,897 A | | 9/1985 | Melton et al. | |
| 4,714,244 A | | 12/1987 | Kolomayets et al. | |
| 5,001,632 A | | 3/1991 | Hall-Tipping | |
| 5,213,555 A | | 5/1993 | Hood et al. | |
| 5,240,417 A | | 8/1993 | Smithson et al. | |
| 5,888,172 A | * | 3/1999 | Andrus et al. | 482/7 |

FOREIGN PATENT DOCUMENTS

| | | |
|---|---|---|
| DE | 43 12 566 | 10/1994 |
| EP | 0 255 142 | 2/1988 |
| EP | 0 758 117 | 2/1997 |
| EP | 0 836 871 | 4/1998 |
| JP | 7-112073 | 5/1995 |
| JP | 11-090046 | 4/1999 |

* cited by examiner

*Primary Examiner*—Glenn E. Richman
(74) *Attorney, Agent, or Firm*—Jordan and Hamburg LLP

(57) ABSTRACT

The present invention is for arousing a sense of rivalry to the user so that the user can exhibit an active will to exercise. The present invention relates to an exercise assistance apparatus which has a cycling machine 1 provided with pedals 11*b* and a rotation sensor 11*c* for detecting the movement of the pedals 11*b*, comprising a monitor 14 for displaying images, means for storing image data to express a traveling path and opponent characters, exercise equipment control means for performing variable control for the load status of the electromagnetic clutch 12*b* of the machine 1, means for sequentially updating and controlling the traveling position of the opponent characters on the traveling path, means for calculating a virtual self position of the user on the traveling path from the detection content of the rotation sensor 11*c* and the load status controlled by the exercise equipment control means, and image display means for displaying the traveling path and opponent characters on the monitor 14, and displaying the degree of difficulty to pass an opponent character.

18 Claims, 22 Drawing Sheets

FIG. 9

TOTAL RESULT

| | |
|---|---|
| TOTAL RANKING | 10 |
| CONSUMED CALORIES | 150Kcal |
| EXERCISE TIME | 4 MIN. 45 SEC. |
| MAXIMUM PULSE RATE | 150 PULSES/MIN. |
| YOUR GOAL TODAY | 200Kcal |

YOU HAVE ALMOST ACHIEVED YOUR GOAL.
KEEP GOING

EXERCISE ASSISTANCE APPARATUS

BACKGROUND OF THE INVENTION

1. Field of the Invention

The present invention relates to an exercise assistance apparatus for supporting traveling movement when a user performs traveling movement on exercise equipment comprising a movable section for the user to perform a traveling movement operation in a loaded status, and a detection section for detecting the movement of the movable section.

2. Description of the Related Art

As an exercise assistance apparatus, an apparatus where a monitor is installed on the front face of a fixed type cycling machine, a character simulating exercise status is displayed on a monitor, also scenery is displayed as background images to bring out the feeling of an actual experience, and a trainer character is displayed who gives appropriate advice to the user on exercise conditions based on the detection content from the pedal rotation sensor and pulse sensor, has been proposed (Japanese Patent Laid-Open 7-250919, Japanese Patent Laid-Open 11-137719, and Japanese Patent Laid-Open 2000-5339).

By displaying characters and background images in this way on a monitor, a certain improvement to prevent conventional boredom resulting from monotonous exercise can be implemented. However, the user merely sees background images which change according to exercise, which merely increases the users interest in exercise somewhat, but does not really reflect the active will of the user. Also, the exercise is still passive, in response to receiving appropriate advice from the trainer character.

SUMMARY OF THE INVENTION

With the foregoing in view, it is an object of the present invention to provide an exercise assistance apparatus which arouses a sense of rivalry in the user so that the user can exhibit an active will in the exercise.

In order to achieve the above goal, the present invention relates to an exercise assistance apparatus which has an exercise equipment where a movable section for a user to perform a traveling movement operation in a loaded status and a detection section for detecting the movement of the movable section are disposed, comprising: a monitor for displaying images which is installed at the front side of the exercise equipment, storage means for storing at least image data to express a traveling path and a predetermined number of opponent characters to be displayed on the traveling path, exercise equipment control means for performing variable control for the load status of the exercise equipment, opponent traveling control means for controlling the traveling positions of the predetermined number of opponent characters on the traveling path with sequential updating, self position calculation means for calculating a virtual self position of the user on the traveling path from the detection content of the detection section and the load status controlled by the exercise equipment control means, and image display means for displaying the traveling path ahead of the self position and opponent characters at an updated traveling position on the traveling path ahead of the self position, and displaying the degree of difficulty to pass the opponent character.

According to the present invention, opponent characters traveling with the exercise equipment character are displayed on the monitor by the image display means, and the degree of difficulty to pass the opponent is displayed, so the user is highly motivated and arouses a sense of rivalry by knowing the degree of difficulty to pass an opponent who is in a position where the user can pass, and the user can exhibit an active will to exercise.

These and other objects, features, and advantages of the present invention will become more apparent upon reading the following detailed description along with the accompanying drawings.

BRIEF DESCRIPTION OF THE DRAWINGS

FIG. 9 is a diagram depicting the total result report screen;

FIGS. 19A to 19D are diagrams depicting other examples of exercise equipment to which the present invention is applied.

DESCRIPTION OF THE PREFERRED EMBODIMENTS

Embodiments of the present invention will now be described.

In the present embodiment, the user competes with an opponent character by peddling a simulated bicycle (fixed cycling machine) on a track, advances in ranking by passing the opponent, and receives support of traveling movement by scenery which moves relatively according to the running (traveling) status of the simulated bicycle, which is displayed on the monitor screen.

Figure 1:
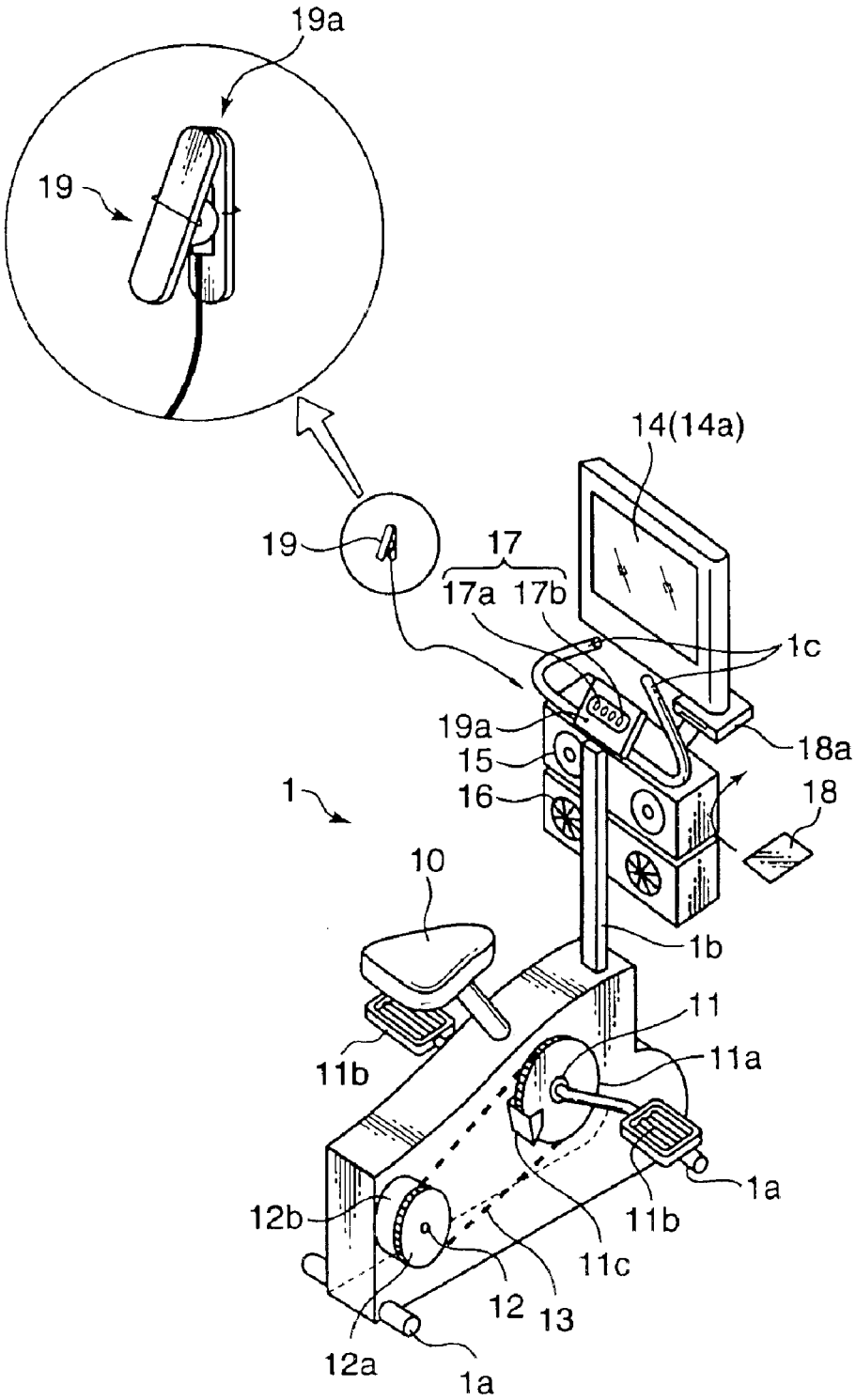
FIG. 1 is a diagram depicting a configuration of a cycling machine as an example of exercise equipment to which the present invention is applied.

FIG. 1 is a diagram depicting a configuration of a cycling machine as an example of the exercise equipment to which the present invention is applied. The cycling machine is a fixed type, in which a bicycle without front and rear wheels is simulated, where a saddle 10 is installed on the upper part of the body 1, legs 1*a* for stabilizing position are installed at the front and back of the lower part of the body 1, and rotation axes 11 and 12, which are horizontal in the left and right directions, are supported inside the body 1 on both sides in the front and back directions. The gears 11*a* and 12*a* are linked to the rotation axes 11 and 12 so as to turn together, and a looped chain 13 is passed between the gears 11*a* and 12*a*. A pair of pedals 11*b* are installed on both sides of the rotation axis 11, which can be pedaled by the user, and this pedaling operation is transferred from the rotation axis 11 via the looped chain 13, and rotates the rear rotation axis 12. In the present embodiment, rotation sensors 11*c*, as detection sections, are disposed facing each other on the rotation axis 11 at the front side, so as to sandwich the gear 11*a*, for example. For the rotation sensor 11*c*, a rotary encoder, which comprises a light emitting section and a light receiving section which face each other, sandwiching the gear 11*a*, for example, is used, where by outputting a pulse each time the tip of the gear 11*a* passes, the rotary encoder generates a rotation pulse and substantially detects the rotation of the pedals 11*b*. Instead of a proximity sensor, such as a rotation sensor comprising a light emitting section and a light receiving section, a mechanical switch can be used, and a rotating part other than the tip of the gear 11*a* may be detected.

An electromagnetic clutch 12*b* is installed on the rear rotation axis 12 as the load change means, so that the brake load amount (braking amount) is changed according to the adjustment of supply power to the electromagnetic clutch 12*b*. For the load change means, not only the electromagnetic clutch which variably controls the braking amount using eddy current, but also various means, such as variably controlling the braking amount of a mechanical brake member by power or hydraulics, may be used.

At the front end of the equipment body 1, a support arm 1*b* is positioned to stand up, and a monitor 14 is installed above the support arm 1*b* at a height which roughly matches the forehead of the user when sitting on the saddle 10, a speaker 15 and a fan 16 are installed under the monitor behind the support arm, and a handle 1*c* is also installed. The monitor 14 is a thin liquid crystal display, for example, to display images. The speaker 15 is for outputting predetermined messages and BGM. The fan 16 is for providing the actual sensation of cycling outdoors, where the fan is controlled so as to rotate at a rotation speed according to the detection result of the rotation sensor 11*c*.

A control panel 17 is installed at the top end of the support arm 1*b*, where at least a pair of buttons 17*a* and 17*b* are equipped at the left and right. These buttons 17*a* and 17*b* correspond to the transmission of an actual bicycle, and can shift the later mentioned gear number for adjusting the brake load amount of the electromagnetic clutch 12*b* by the user pressing these buttons, and, for example, each time the button 17*a* is pressed once, the gear number is shifted and the break load amount of the electromagnetic clutch 12*b* increases, and each time the other button 17*b* is pressed once, the gear number is shifted and the break load amount of the electromagnetic clutch 12*b* decreases.

A card reader 18*a*, where a personal card 18 can be inserted in and removed, an entry 19*a* for inserting the tip of the lead wire of the pulse sensor 19, are installed near the monitor 14. The personal card 18 is a magnetic card or an IC card where user ID, height, weight, birthday, etc. are stored, and the card reader 18*a* allows reading or writing information from/to the inserted personal card 18, although this is not shown in FIG. 1. The pulse sensor 19 is for detecting the pulse of the user, which has a clip 19*a* for clipping to an ear lobe, for example, as shown in the enlarged view, and optically detects the change of blood flow amount from the change of transmitted light quantity in the state of the ear lobe where the pulse sensor is clipped.

At an appropriate location of the cycling machine, a control section 2 (see FIG. 2) comprised of a microcomputer for inputting detection signals from each section or outputting control signals to each section is installed. The control section 2 may be separately installed instead of being installed to each exercise equipment.

Figure 2:
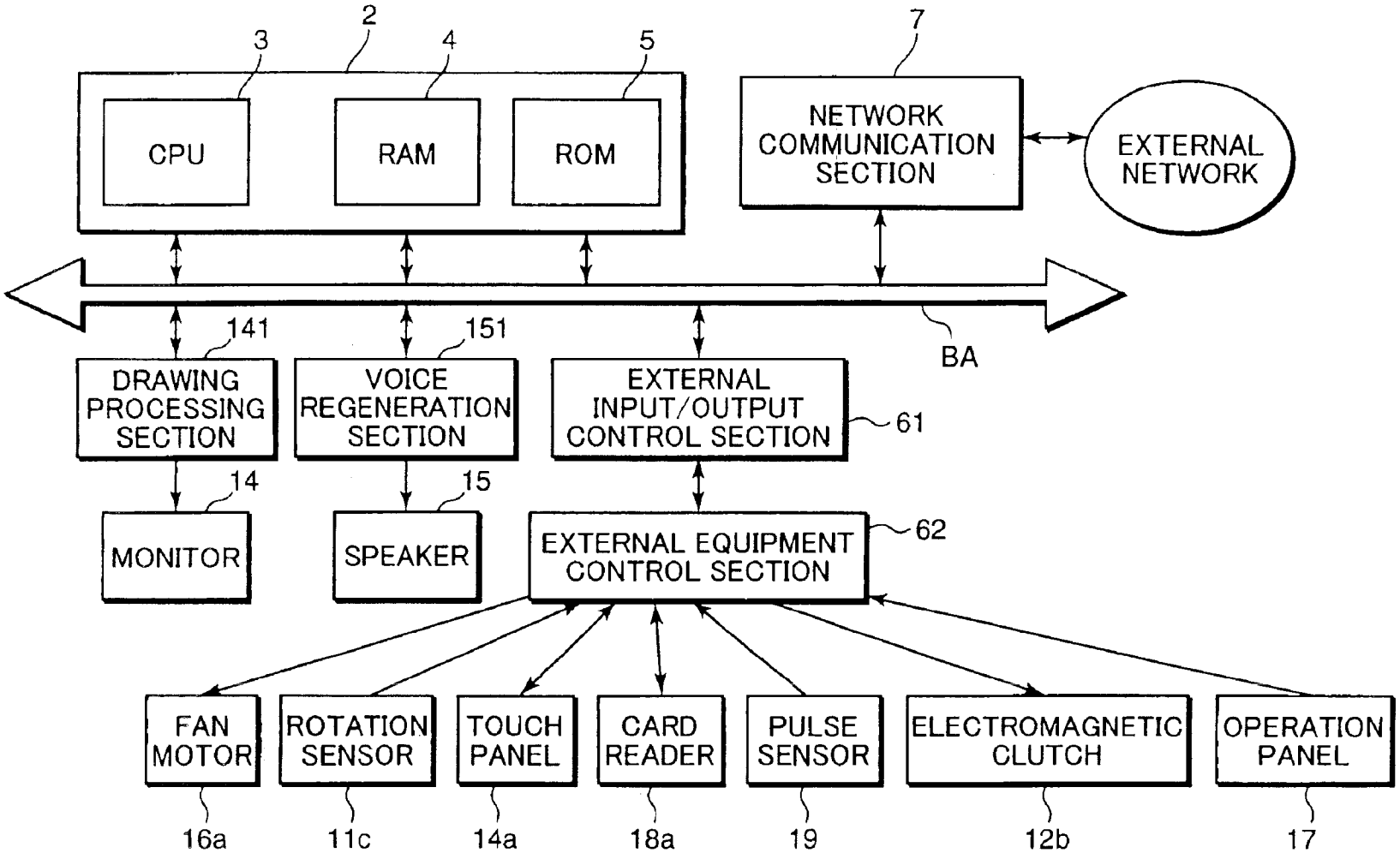
FIG. 2 is a hardware block diagram depicting an embodiment of the exercise assistance apparatus according to the present invention.

FIG. 2 is a hardware block diagram depicting an embodiment of the exercise assistance apparatus according to the present invention. The control section 2 is for controlling the general operation of this exercise assistance apparatus, and is comprised of an information processing section (CPU) 3, RAM 4 for temporarily storing information during processing, and ROM 5 where the later mentioned predetermined image information, various data for exercise support processing, the later mentioned various tables and control programs for exercise support have been stored. In the ROM 5, control programs which are influenced by the change of the content of exercises and support methods thereof are influenced by change, for example, may be stored in a removable type external recording medium. The bus BA is a data transmission line.

The external input/output control section 61 converts detection signals into digital signals for processing, or converts the instruction information into control signals for an actuator and outputs those signals between the control section 2 and the actuator {that is, fan motor 16*a* of the fan 16, and card reader (read writer) 18*a* for card 18 (writing)}, and detection section {that is, rotation sensor 11*c*, touch panel 14*a*, control panel 17, card reader (read writer) 18*a* for card 18 (reading), pulse sensor 19 and electromagnetic clutch 12*b*}, and executes such signal processing and input/output processing, in time division periods, for example. The external equipment control section 62 executes an operation to output control signals to each actuator and an operation to input detection signals from each detection section during the respective time division period. The touch panel 14*a* of the detection section has a plurality of pressing operation sections which are turned ON/OFF by the pressing operation of a finger, and is installed on the screen of the monitor 14.

The drawing processing section 141 is for displaying required images on the monitor 14 according to an image display instruction from the control section 2, and has a video RAM. The voice regeneration section 151 is for outputting predetermined messages and BGM to the speaker 15 according to an instruction from the control section 2.

The information on the personal card 18 includes user ID, height, weight, birthday, gender, training goal and achievements in a predetermined number of times of training in the past (training history), the progress status up to the present, and basic athletic capabilities in the present embodiment. The above mentioned progress status up to the present and the basic athletic capabilities are updated and stored. On the personal card 18, the above mentioned information on other types of exercises equipment shown in FIGS. 19A to 19D, for example, other than this cycling machine, can all be stored, and it is preferable that information of each equipment and the total information of all the equipment (e.g. game score) can be stored as organizing information, if necessary.

Figure 4:
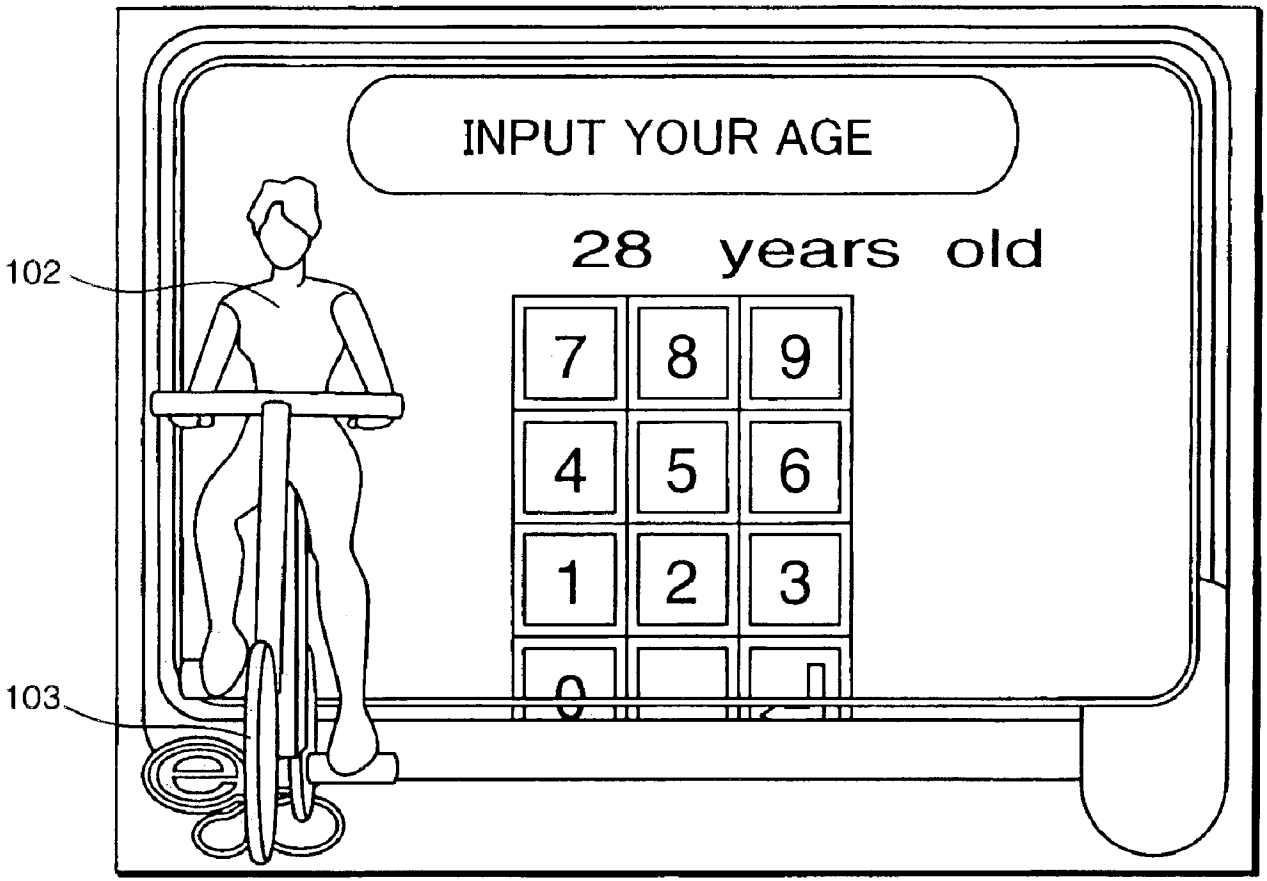
FIG. 4 is an initial screen which is switched to display when an appropriate location of the touch panel on the standby screen is pressed.
Figure 6:
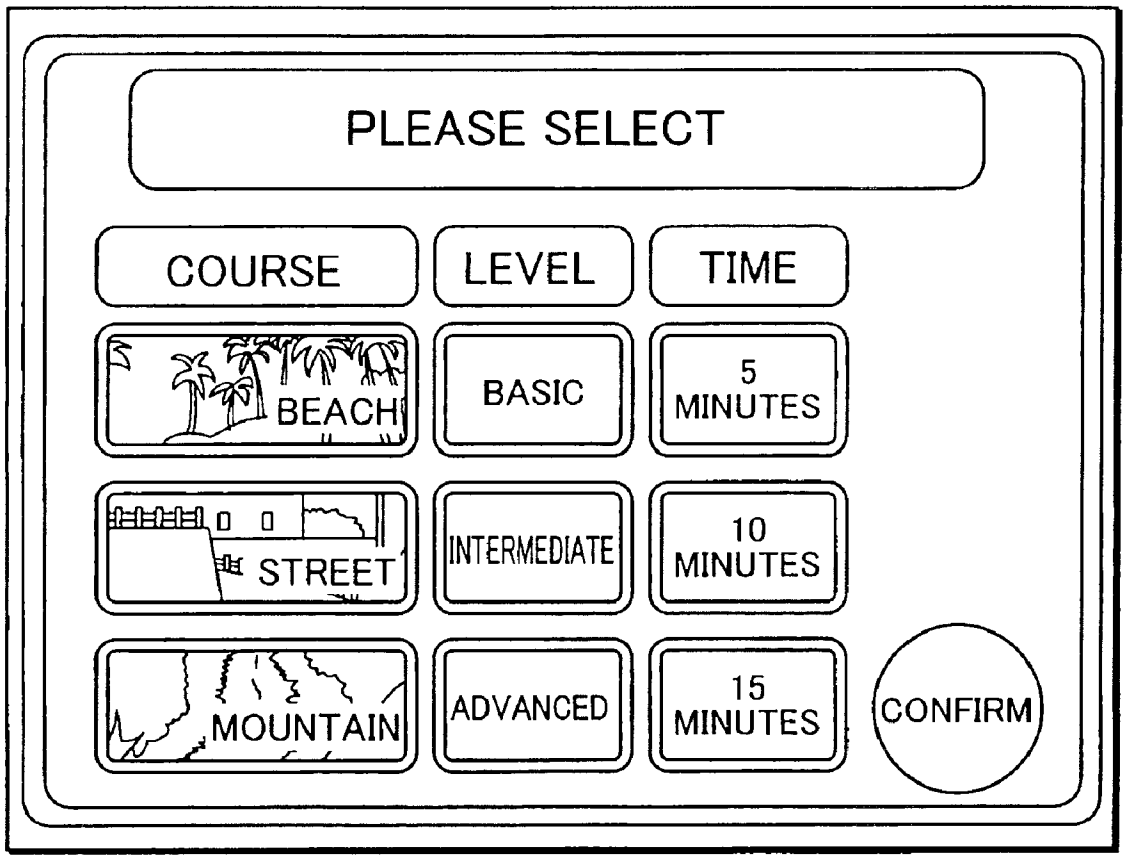
FIG. 6 is a diagram depicting the screen for selecting the type of exercise.
Figure 8:
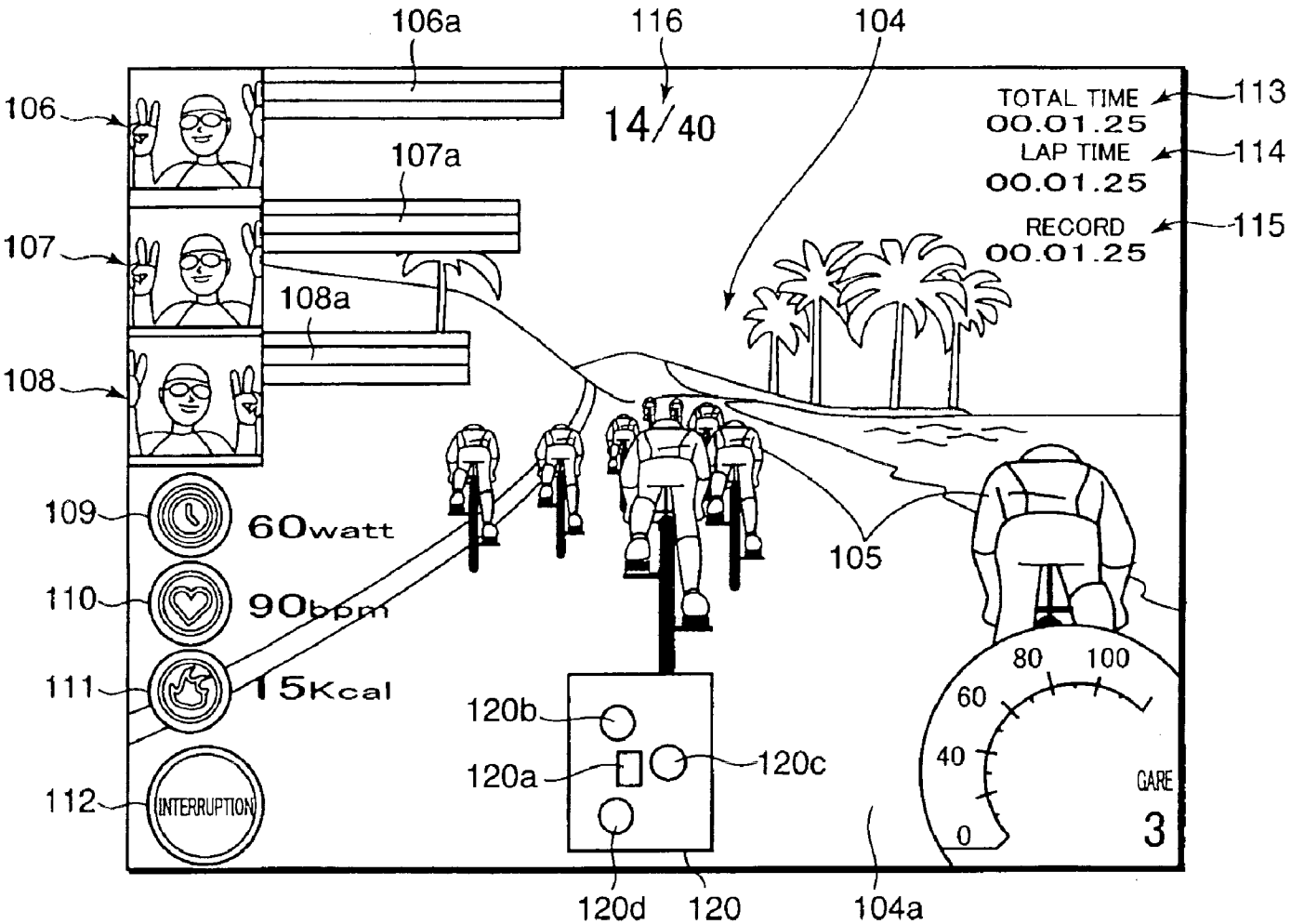
FIG. 8 is a diagram depicting a screen at a point when a predetermined time has elapsed since start.

On the ROM 5, a role playing character 102 simulating what the user used in FIG. 4, a cycling machine character 103, a background image 104 including the road character 104*a* used during the exercise shown in FIG. 8, opponent characters 105 pedaling bicycles, three head characters 106, 107 and 108, which exist near (point blank range) of the user at the upper left of FIG. 8, physical strength levels 106*a*, 107*a* and 108*a* which are displayed as guides corresponding to each head character 106–108, brake load amount (unit: watts) 109 of the electromagnetic clutch 12*b*, pulse rate (unit: bpm) 110, consumed calorie value (unit: Kcal) 111, and the touch section for interruption 112 at the lower left section in FIG. 8, the total time from the start of exercise 113, lap time of the user 114, and record time up to the present 115 at the upper right in FIG. 8, user 120*a* and three opponents 120*b*, 120*c* and 120*d* near the user in the area 120 at the lower part in FIG. 8, and the images of the selected screen and the result report screen and various messages shown in FIG. 6 are stored in superimposed enabled status. The opponent character 105 and the background image 104 are comprised of a predetermined number of constituting polygons so as to be drawn three-dimensionally, the drawing processing section 141 mainly performs viewpoint position calculation (later mentioned height of camera, change of direction, etc. in the present embodiment), calculation in three-dimensional space with respect to the viewpoint position, calculation for converting a position in three-dimensional space into a position in pseudo-three-dimensional space, and light source calculation processing, based on a drawing instruction from the CPU 3, and also performs write processing of image data to be drawn to video RAM based on the above calculation result, such as writing (pasting) texture data into an area of video RAM specified by polygons.

Now the relationship between the operation of the CPU 3 and the operations of the drawing processing section 141 will be described. The CPU 3 reads images, voices, control programs and game programs from the ROM 5 based on the operating system recorded in the internal or external removable ROM 5. A part or all of an image, voice and control data which was read is held in the RAM 4. Hereafter the CPU 3 progresses processing based on the control program, data (image data including polygons and the texture of displayed objects and other text images, and voice data) stored in the RAM 4, detection signals from the detection section, and content instructed via operation by the user. In other words, the CPU 3 generates commands as tasks for drawing and voice output based on the detection signals and content instructed by the user. Based on these commands, the drawing processing section 141 performs calculation of the viewpoint position, calculation of the position of the character in three-dimensional space (or in two-dimensional space) with respect to the viewpoint position, calculation of the light source, generation of voice data, and processing. Then based on the above calculation result, the drawing processing section 141 performs writing of image data to be drawn in the video RAM. The image data written in the video RAM is supplied to the monitor 14 (after being supplied to the D/A converter via the interface and converted into analog image signals), and is displayed on the screen as images. The voice data which is output from the voice regeneration section 151 is output from the speaker 15 as voice (via an amplifier after being supplied to the D/A converter via the interface and converted into analog voice signals).

Drawing instructions include drawing instructions for drawing three-dimensional images using polygons, and drawing instructions for drawing ordinary two-dimensional images. Here a polygon is a polygonal two-dimensional image, and in the present embodiment, a triangle or square is used. The drawing instructions for drawing a three-dimensional image using polygons is comprised of polygon vertex address data which is read from the ROM 5, texture address data which indicates the storage position of texture to be pasted onto polygons, color palette address data which indicate the storage position of color palette data to indicate the color of texture data, and luminance data which indicates the luminance of texture. One object consists of many polygons. The CPU 3 stores the coordinate data of each polygon in a three-dimensional space in the RAM 4. When a character or a background image is moved on a screen of the monitor 14, that is, when a viewpoint position is changed, the following processing is executed. That is, the CPU 3 sequentially determines the three-dimensional coordinate data after the movement and after the rotation of each polygon based on the three-dimensional coordinate data of the vertexes of each polygon which is temporarily stored in the RAM 4, and the movement amount data and rotation amount data of each polygon. Out of the three-dimensional coordinate data of each polygon determined in this way, the coordinate data in the horizontal and vertical directions are supplied to the drawing processing section 141 as address data on the display area of the RAM 4, that is, polygon vertex address data. The drawing processing section 141 writes texture data, which is indicated by epreassigned texture address data, on the triangle or square display area indicated by 3 or 4 polygon vertex address data. By this, an object (e.g. character), where texture data is pasted onto many polygons, is displayed on the display face of the monitor 14.

Out of the various types of data stored in the ROM 5, data which can be stored in a removable recording medium may be readable by such a drive as a hard disk drive, optical disk drive, flexible disk drive, silicon disk drive and cassette medium reader, and in this case, the recording medium 5 is, for example, a hard disk, optical disk, flexible disk, CD, DVD or semiconductor memory.

The network communication section 7 is for updating and storing various information, which is to be updated on the personal card when training is over, to a management server, which is not in the drawing, via an external network (e.g. Internet). If the training history of the user is collectively managed in this way, then the list of users who have a high level of consumed calories, which is described later, can be displayed by ranking on the monitor for the information report disposed in a gym, and by this information, the user can be motivated to train. If the address information of the management server is notified to the user (member) in advance, then the member can personally confirm his/her training history from his/her own communication equipment.

Figure 3:
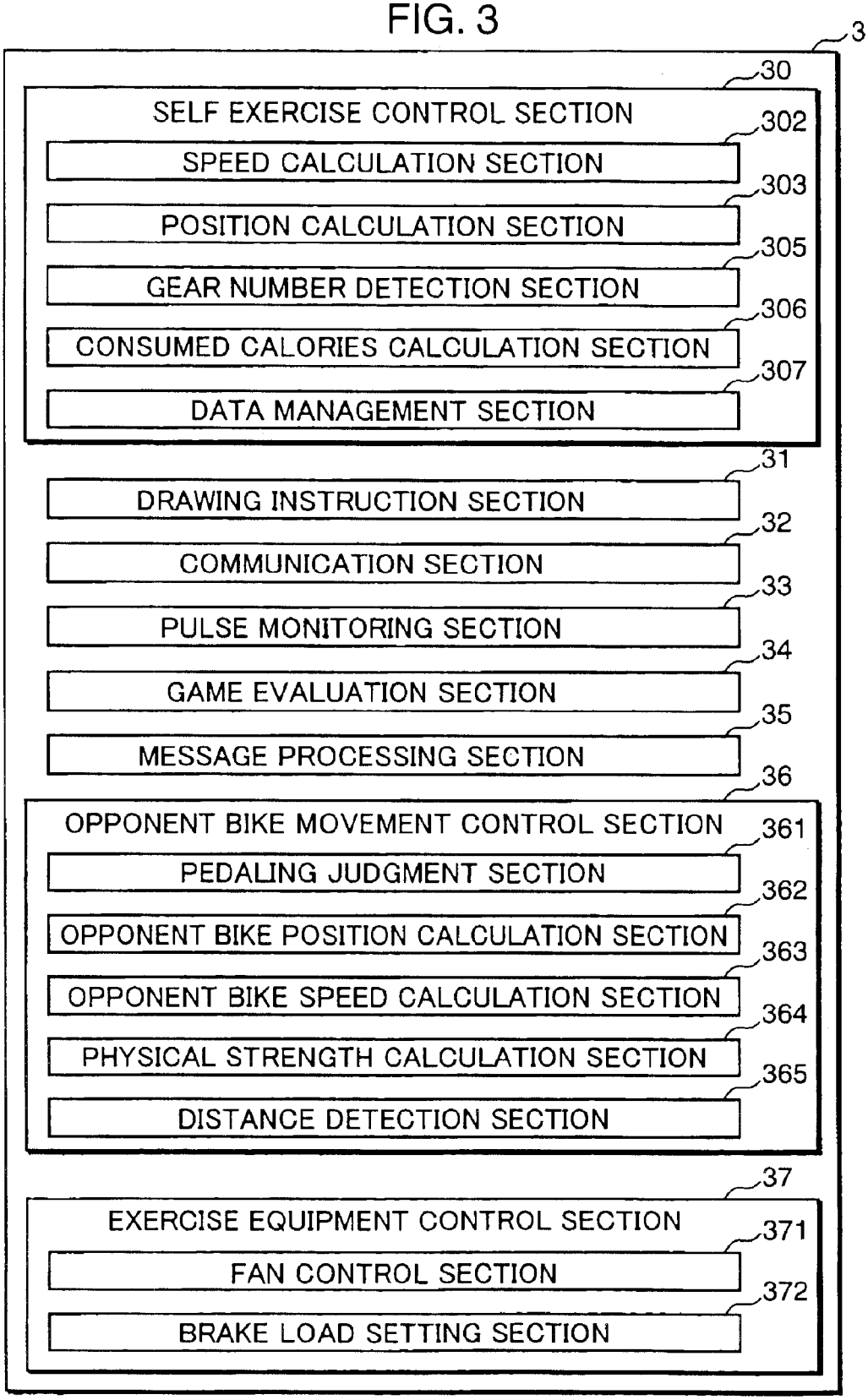
FIG. 3 is a software block diagram of the CPU.

FIG. 3 is a software block diagram of the CPU 3. The CPU 3 is comprised of a self exercise control section 30, drawing instruction section 31, a communication section 32 for controlling the reading and writing of data from/to the personal card 18, a pulse monitoring section 33 which calculates the pulse rate per minute from the detection signal by the pulse sensor 19, monitoring the difference from the predetermined value that has been set, and judges "Normal", "Somewhat Dangerous" or "Dangerous Area", a game evaluation section 34, a message processing section 35 which superimposes and displays messages (including warnings), such as "Pulse sensor disconnection warning" displayed when the pulse sensor timer elapses after a predetermined time or more, "Pace down" displayed when "Somewhat Dangerous" is judged, and "Train Warning", that is "Temporarily stop the game" is displayed, when the pulse rate information monitored by the pulse monitoring section 33 is "Dangerous Area" on the monitor 14, an opponent vehicle movement control section 36 as the opponent traveling control means, and an exercise equipment control section 37 as the exercise equipment control means. The functions of the opponent bike movement control section 36 and the exercise equipment control section 37 will be described later with reference to FIG. 8. The CPU 3 comprises a training timer for monitoring training time, pulse sensor timer for counting time when the pulse sensor 19 is disconnected, dangerous status continuation timer for counting time judged as "Somewhat Dangerous", which will be described later, and rotation sensor timer for counting time when a detection signal from the rotation sensor 11*c* is not input since pedals 11*b* are not in use.

The self exercise control section 30 is mainly to manage the exercise status of the user, and is comprised of a speed calculation section 302 which calculates the acceleration amount of the self bike speed based on the cycle of rotation signals from the rotation sensor 11*c* and the later mentioned self bike acceleration table stored in the ROM 5, determines the deceleration amount assuming that there is friction between the bicycle and the ground from the calculation value, and calculates the rotation speed of the pedals 11*b* (traveling speed of the pseudo-cycling machine), a position calculation section 303 as a self position calculation means which calculates the position of the bike vehicle from the start point, that is, the current position of the self bike (e.g. number of meters from the start point) by integrating the calculated self bike speed, a gear number detection section 305 which detects the gear number which is set in the later mentioned self vehicle gear table and gear number which is changed to by the push operation of the buttons 17*a* and 17*b*, and increases/decreases the gear number which is set to the gear number to be changed to when the gear number is changed by the buttons 17*a* and 17*b*, a consumed calorie calculation section 306 which determined the consumed calories per unit time from the speed determined by the speed calculation section 302, pulse rate determined by the pulse monitoring section 33, and such parameters as age and weight read from the personal card 18, and calculates the consumed calories from the start of exercise to the current point of time by accumulating the determined consumed calories per unit time for the exercise time, and a data management section 307 for managing various personal data, such as training history.

The above mentioned speed calculation section 302 and the position calculation section 303 repeatedly performs processing at a predetermined time pitch, and the position calculation section 303 outputs the relative fore and aft positional relationship between the self bike position and the opponent character position, which is determined by the later mentioned opponent bike position calculation section 362, to the drawing instruction section 31. The consumed calorie calculation section 306 may determine the consumed calories per unit time by reading the consumed calories from the table memory where the consumed calories have been stored as a table based on the above mentioned parameters.

The drawing instruction section 31 is for sending the above mentioned drawing instructions to the drawing processing section 141, and the drawing instruction section 31 and the drawing processing section 141 constitute the image display means. The drawing instruction section 31 and the drawing processing section 141 display the opponent character 105 on the monitor 14 based on the relative fore and aft positional relationship between the self bike position and the opponent character position from the position calculation section 303. The game evaluation section 34 assigns a higher score as the self bike approaches or passes the opponent character 105 immediately in front of the user, and in the present embodiment, a value indicate ranking from the top character becomes smaller each time the self bike passes the opponent character 105.

Now the images to be displayed on the monitor screen will be described with reference to FIG. 4 to FIG. 9. FIG. 4 is an initial screen which is displayed when an applicable press operation section of the touch panel 14*a* on the standby screen is pressed, and the numbers "0" to "9" are displayed in a matrix along with a phrase prompting for the input for age. If "2" and "8" are pressed in sequence, for example, by pressing the numeric parts corresponding to the age of the user, then "28 years old" is displayed for confirmation. The buttons on the fourth line from the top in the second row is for cancellation (reinput possible), and the button on the third row of this line is for defining. These numerics "0" to "9" and the two buttons are arranged corresponding to the press operation section on the touch panel 14*a*. In FIG. 4, FIG. 5, FIG. 7, FIG. 10 and FIG. 11, the role playing character 102 and the cycling machine character 103 are displayed at an appropriate location of the screen, at the right in the case of the present embodiment, in a state where the camera viewpoint is at the front.

Figure 5:
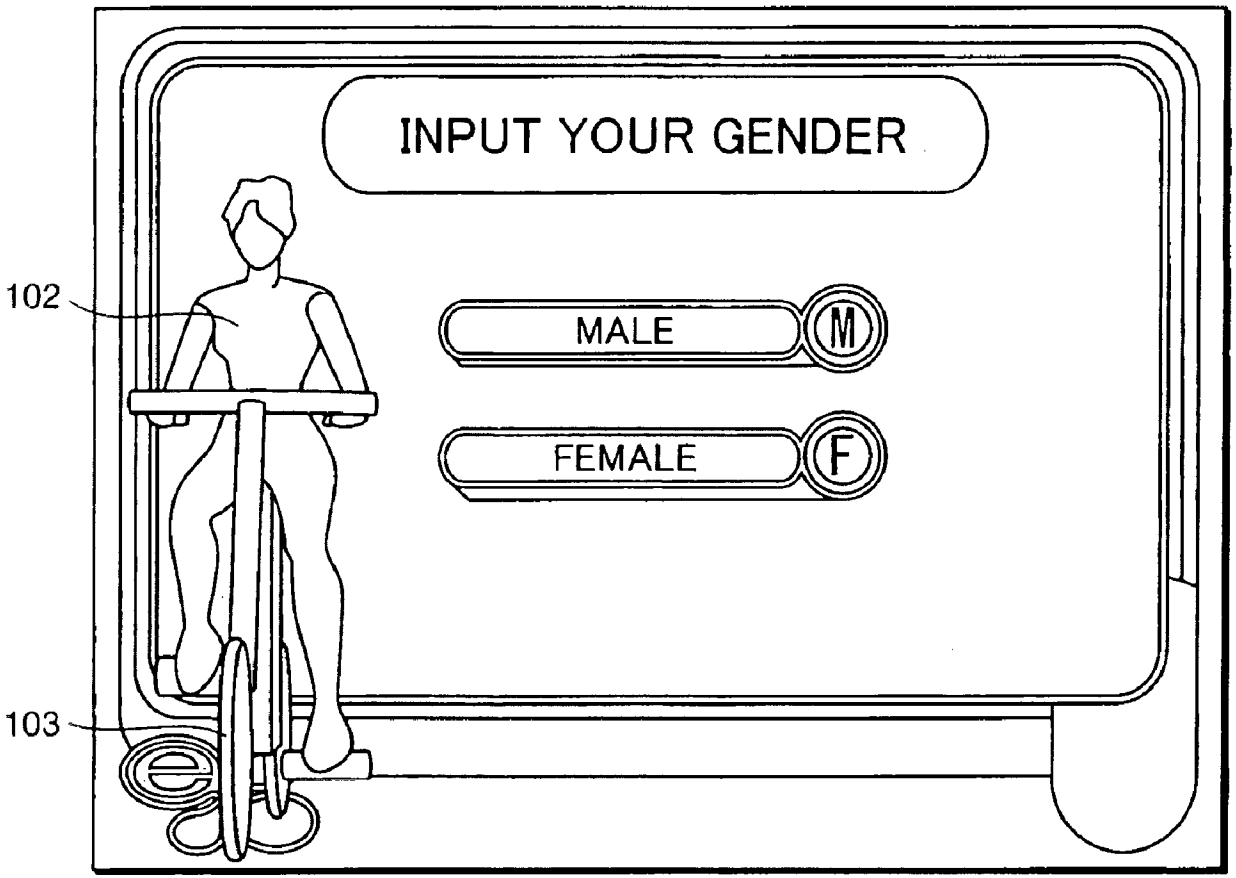
FIG. 5 is a diagram depicting the screen for guiding input to select gender.

FIG. 5 is a screen to prompt the input for gender after the input for age, and the buttons "Male" and "Female" are selectably displayed corresponding to the press operation section of the touch panel 14*a*.

FIG. 6 is a guide screen prompting to select the type of exercise of the user after the input for gender, and in the present embodiment, three choices have been set respectively for the three items "Course", "Level" and "Time", and for "Course", "Beach", "Street" and "Mountain" have been set, for "Level", "Basic", "Intermediate" and "Advanced" have been set, and for "Time", "5 minutes", "10 minutes" and "15 minutes" have been set, and these nine choices are selectably displayed corresponding to the press operation section of the touch panel 14*a*. Out of these nine types of exercises, for the three "Courses", a road table associating the traveling distance from the start to the goal and the inclination level (inclination information) of the slope, and a self bike gear table where the gear numbers corresponding to the inclination level of the slope are set, have been set in the ROM 5. The self vehicle gear table is used for adjusting the brake load amount of the electromagnetic clutch 12*b* for adjusting the load of the pedals 11*b* used by the user, and the gear number being set is, for example, "3" when the inclination level is flat, three levels from "4" to "6" for climbing, which increases as the inclination angle increases, and two levels, "1" or "2", for descending, which decreases as the inclination angle increases. When the set value of the gear number is "3" to "6", speed decreases and the brake load amount decreases as the gear number approaches "3", and speed increases and the brake load amount increases as the gear number approaches "6", and when the set value of the gear number is "2", the brake load amount decreases and speed increases compared with the set value "3", and when the set value of the gear number is "1", the brake load amount further decreases and speed increases compared with the set value "2".

The gear number setting is changed by the operation of the buttons 17*a* and 17*b* by the user. For example, if the button 17*a* is pressed down once when the gear number setting is "4", for example, the gear number setting is changed to "5", and is changed to "6" if the button 17*a* is pressed down twice, and if the button 17*b* is pressed down once when the gear number setting is "4", for example, the gear number setting is changed to "3", and is changed to "2" if the button 17*b* is pressed down twice. In the present embodiment, however, the gear number can be changed in a range where the value after change is "1" to "6".

Along with the selection of the three "Level", the setting value for making a fine adjustment of the brake load amount of the electromagnetic clutch 12*b* in the entire period from the start to goal, such as "1" for "Intermediate", "0.9" for "Basic", and "1.1" for "Advanced", have been set, and these setting values have been stored in the ROM 5 as the degree of difficulty table. The brake load amount is set to a value corresponding to the gear number if "Intermediate" is selected, to a value of a lower load than the gear number if "Basic" is selected, and to a value of a higher load than the gear number if "Advanced" is selected. The gear number here is a gear number being set in the self bike gear table when the buttons 17*a* and 17*b* were not pressed down, and is a gear number after the gear number being set in the self bike gear table is changed by the buttons 17*a* and 17*b* when the buttons 17*a* and 17*b* were pressed. The acceleration amount is set in the above mentioned self bike acceleration amount table based on such a gear number, and the acceleration amount increases as the gear number increases (brake load amount increases) when the gear number is from "3" to "6", and the acceleration amount decreases as the gear number decreases (brake load amount decreases) when the gear number is from "3" to "6", whereas when the gear number is from "1" to "2" this relationship reverses itself in the case of when the gear number is "3" to "6". The setting values of the degree of difficulty table may be different values.

Figure 7:
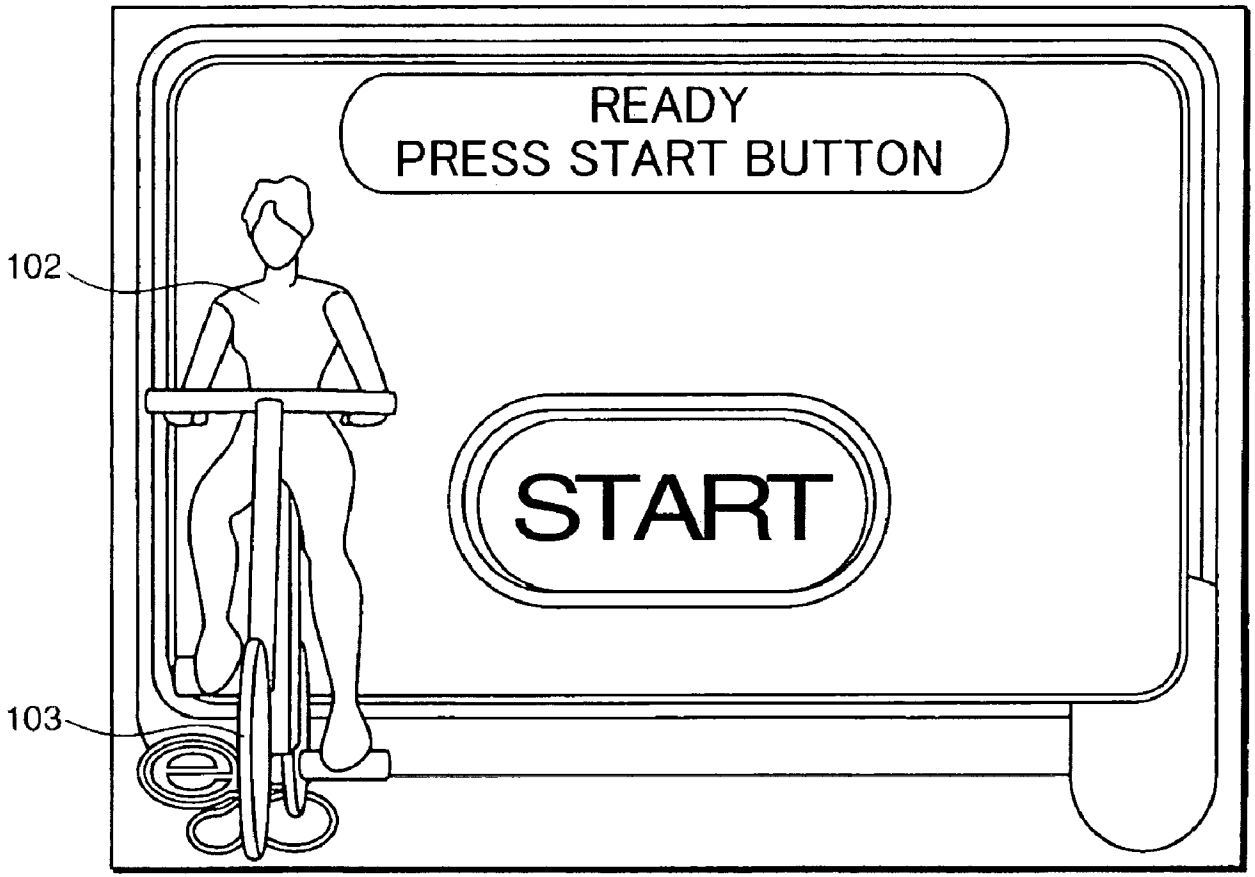
FIG. 7 is a diagram depicting the start/standby screen.

FIG. 7 is a start/standby screen when the input of personal data is completed, where the "START" button is displayed at the center, which can be pressed corresponding to the press operation section of the touch panel 14*a*.

FIG. 8 shows a screen when 1 minute 25 seconds, for example, have passed since start. On the screen, the scenery image (background image) 104, which has a road character 104*a* (a part of the track) which is a traveling path, is displayed as a background, and on the road character 104*a*, opponent characters 105 pedaling bicycles are displayed with the eye of the user as the camera viewpoint. In other words, the opponent character 105 is displayed as a rule as if the character is pedaling at a speed corresponding to the later mentioned speed information which is obtained by the opponent bike movement control section 36, and as the user pedals faster, the relative position with the opponent character 105 becomes closer, and the background image 104 moves relatively in the backward direction so as to create a traveling effect. The opponent character 105 is displayed as if the character is not pedaling in a certain case (when output from the pedaling judgment section 361 is received), as described later. At predetermined locations 113, 114, 115, . . . on the screen, the above mentioned total time, lap time, record time, etc. are displayed.

FIG. 9 shows a screen of "Total Result" displayed after exercise of the user is over, where total ranking (10), consumed calories (150 Kcal), exercise time (4 minutes 45 seconds), maximum pulse rate (150 pulses/min.), and "your goal today" (200 Kcal) are displayed from the top in sequence.

Figure 10:
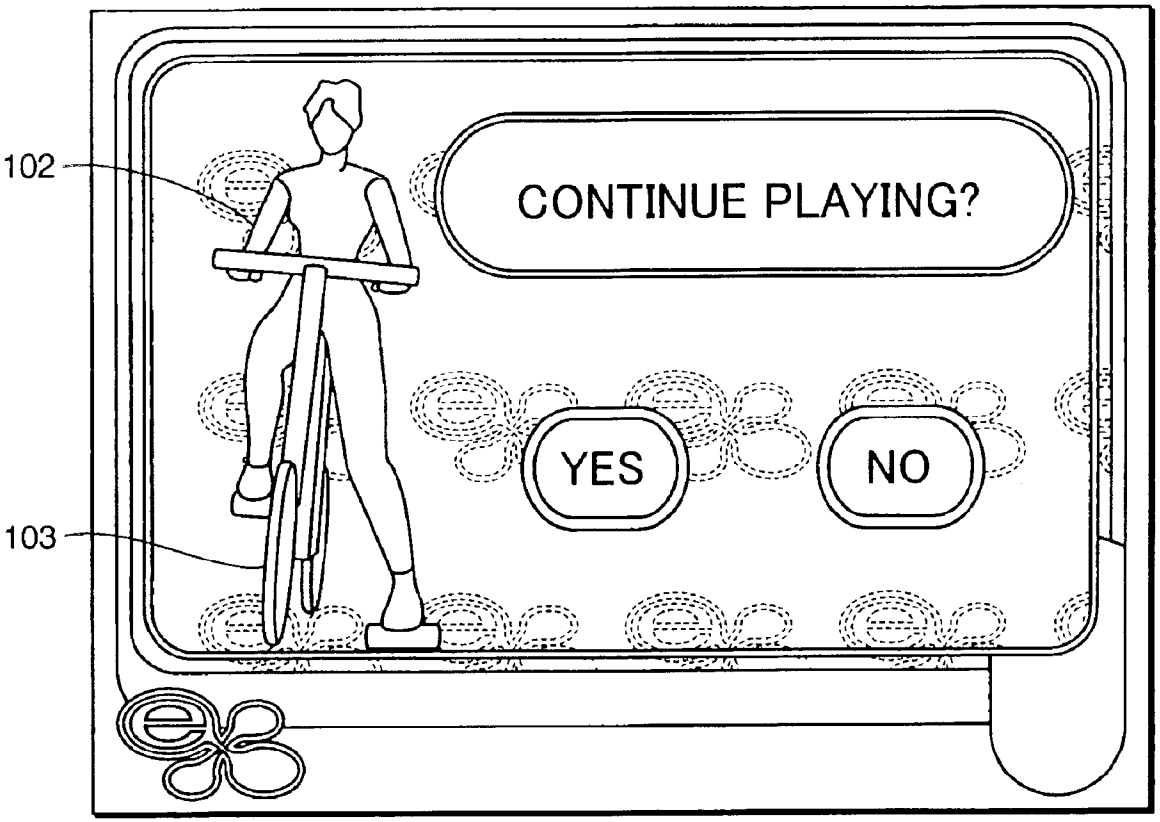
FIG. 10 is a diagram depicting a screen for confirming whether the exercise is to continue.
Figure 11:
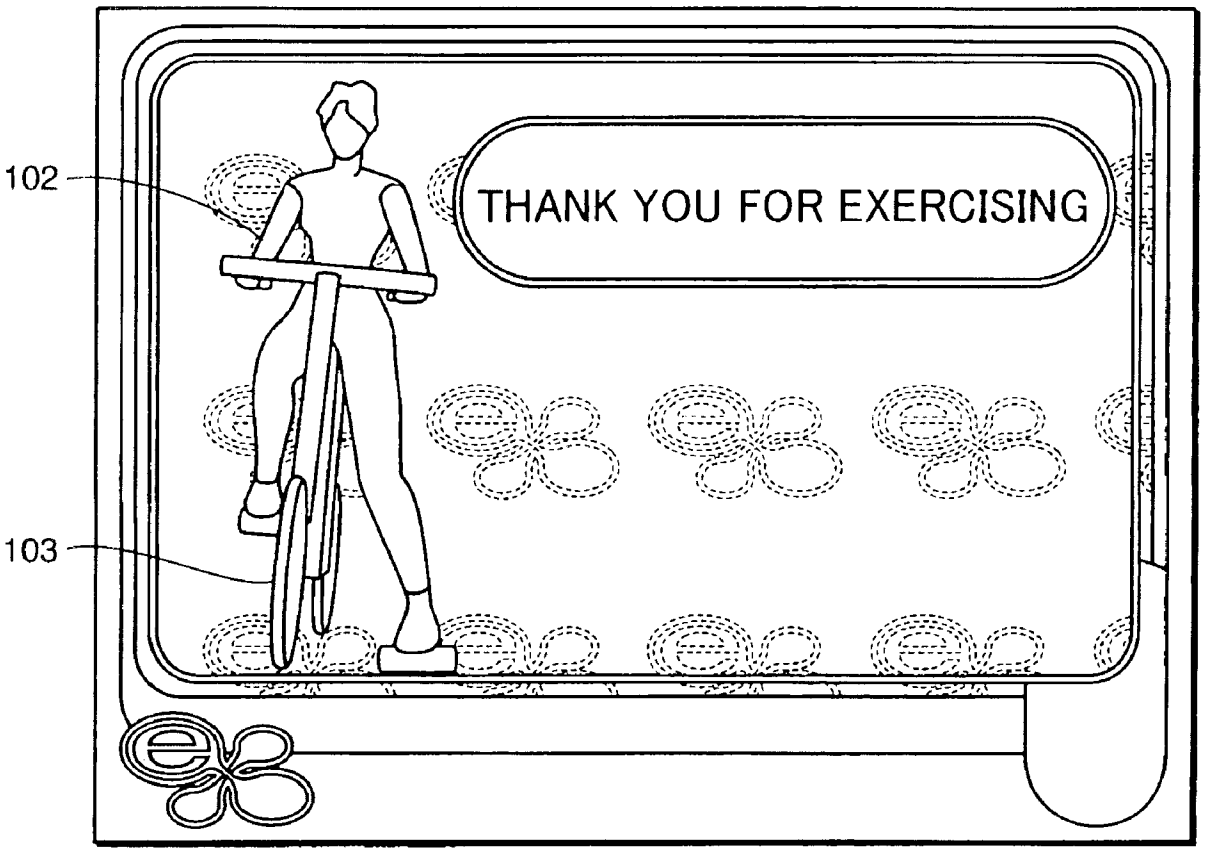
FIG. 11 is a diagram depicting a screen which is switched to when "No" is selected in FIG. 10.

FIG. 10 is a screen for confirming whether exercise is to continue, where "Yes" and "No" are selectably displayed corresponding to the press operation section of the touch panel 14*a*. FIG. 11 is a screen to be switched to when "No" is selected in FIG. 10, and the message "Thank you for exercising" is displayed.

The road character 104*a* in FIG. 8 is displayed on the monitor 14 according to the inclination level which is set in the road table. The opponent characters 105 travel at a speed according to the gear number in the first opponent bike gear table or second opponent bike gear table, where the gear number according to the inclination level, which is set in the road table, is set, regardless whether the opponent character 105 pedals or not. The first opponent bike gear table is a gear selection table in the traveling status which is selected and used when the opponent character 105 is not nearby (not within point blank range), where the gear numbers are set in the same way as the self bike gear table, and the opponent character 105, which travels with the gear number in the first opponent bike gear table, travels at a same speed as the self bike gear table. The second opponent bike gear table, on the other hand, is a gear selection table which is selected and used when the opponent character 105 is within point blank range, that is, in competing status with the self bike, where the gear numbers are set so as to be higher (e.g. one value higher) than the gear numbers of the first opponent bike gear table, therefore this opponent character 105 travels at a speed faster than the opponent character 105 which travels based on the first opponent vehicle gear table. When the second opponent bike gear table is used, setting is based on the assumption that the opponent character 105 pedals, and both the first and second opponent bike gear tables are stored in the ROM 5.

Now the functions of the opponent bike movement control section 36 and the exercise equipment control section 37 as described in the above with reference to FIG. 3 will be described with reference to the screen display in FIG. 8. At first, the opponent bike movement control section 36, shown in FIG. 3, comprises a pedaling judgment section 361 for judges whether the opponent character 105 pedals or not, an opponent bike position calculation section 362 for detecting each position (distance from start point in meters) of a plurality of opponent characters 105, which is forty in the present embodiment, an opponent bike speed calculation section 363 for calculating the opponent bike speed, a physical strength calculation section 364 for calculating physical strength, and a distance detection section 365 for specifying an opponent character 105 to be a substantial target to pass by who is near (in point blank range) the user, such as within 10 meters ahead and behind the self bike, based on the calculation result of the opponent bike position calculation section 362 and the position calculation section 303, and determining the distance difference between the position of the specified opponent character 105 and the self bike position.

The pedaling judgment section 361 judges that the opponent character 105 does not pedal when the gear number of the first opponent bike gear table is "2" or less, for example, and outputs a display signal to the drawing instruction section 31 to display this information, and outputs the judgment signal to the physical strength calculation section 363. The distance detection section 365 outputs the signal related to the opponent character 105, which was specified as the target to pass by and is within point blank range, to the drawing instruction section 31 and the physical strength calculation section 363, and outputs the signal related to the distance difference to the physical strength calculation section 363. By this, three head characters 106–108 are displayed on the monitor 14, as shown in FIG. 8. FIG. 8 shows an example when there are three opponent characters within point blank range, and if a different number of opponent characters are within point blank range, then the head characters and physical strength thereof are displayed for that number.

The physical strength calculation section 364 is for performing calculation such that physical strength is recovered when each opponent character 105 does not pedal, and physical strength is decreased according to the gear number when each opponent character 105 pedals. This calculation of the decrease of physical strength is performed based on the physical strength table which has been stored in the ROM 5 in advance, and the physical strength table is prepared for the number of all the opponent characters 105 (e.g. for forty), where the physical strength decrease value is arbitrarily set for each opponent character 105. For the basic setting content of the physical strength table for all the opponent characters 105, the physical strength decrease value is set such that physical strength decreases more as the gear number increases, and physical strength decreases less as the gear number decreases, for example. And when the first opponent bike gear table is selected and used, the physical strength calculation section 364 calculates so that the physical strength is decreased even more when the opponent character pedals with a high gear number, the physical strength is decreased less when the opponent character pedals with a low gear number, and the physical strength recovers a predetermined recovery amount without using a physical strength decrease value when the opponent character does not pedal. When the second opponent bike gear table is selected and used, the physical strength decrease value being set in the physical strength table is changed to a greater value, for example, changed to a physical strength decrease value when the physical strength decrease value being set in the physical strength table is multiplied by a multiple (1<) according to the distance difference provided by the distance detection section 365, and the same calculation is performed using this physical strength decrease value. The obtained physical strength value is then output to the drawing instruction section 31, and the length of the level of the physical strengths 106*a*, 107*a* and 108*a*, which are displayed as a guide display shown in FIG. 8, are changed. In the present embodiment, this length of physical strength levels is used for the degree of difficulty to pass by an opponent.

The opponent bike speed calculation section 363 calculates the acceleration amount of each opponent character 105 based on the opponent bike acceleration amount table where the acceleration amount has been set according to the gear number of the first opponent bike gear table and second opponent bike gear table, when this opponent character 105 pedals, determines the speed of the opponent bike by subtracting a predetermined deceleration amount (friction with the ground) from the calculated acceleration amount, and outputs the determined value to the opponent vehicle position calculation section 362 and the drawing instruction section 31. The opponent bike acceleration amount table is the same as the self bike acceleration amount table, and is stored in the ROM 5. The opponent bike position calculation section 362 calculates the position of each opponent character 105 from the start point by integrating the speed of the opponent bike.

The exercise equipment control section 37 is comprised of a fan control section 371 and a brake load setting section 372, and the fan control section 371 controls the rotation of the fan 16 based on the rotation signal from the rotation sensor 11*c* and the fan table, which has been stored in the ROM 5 in advance (table where the rotation frequency of the rotation sensor 11*c* and rotation of the fan 16 are associated). At this time, the fan table is set such that the rotation of the fan 16 is stopped when the rotation frequency of the rotation sensor 11*c* is "0".

The brake load setting section 372 determines the brake load amount of the electromagnetic clutch 12*b* based on the gear number detected by the gear number detection sensor 305, inclination level being set in the road table, and a fine adjustment setting value ("0.9", "1", or "1.1") of the brake load amount according to the "Level" selection in FIG. 6, and also sets the brake load amount of the electromagnetic clutch 12*b* where the determined brake load amount is decreased at a predetermined rate (e.g. 0.9 times), when the pulse rate is judged as "Slightly Dangerous".

Now the procedure of exercise support will be described with reference to a flow chart.

Figure 12A:
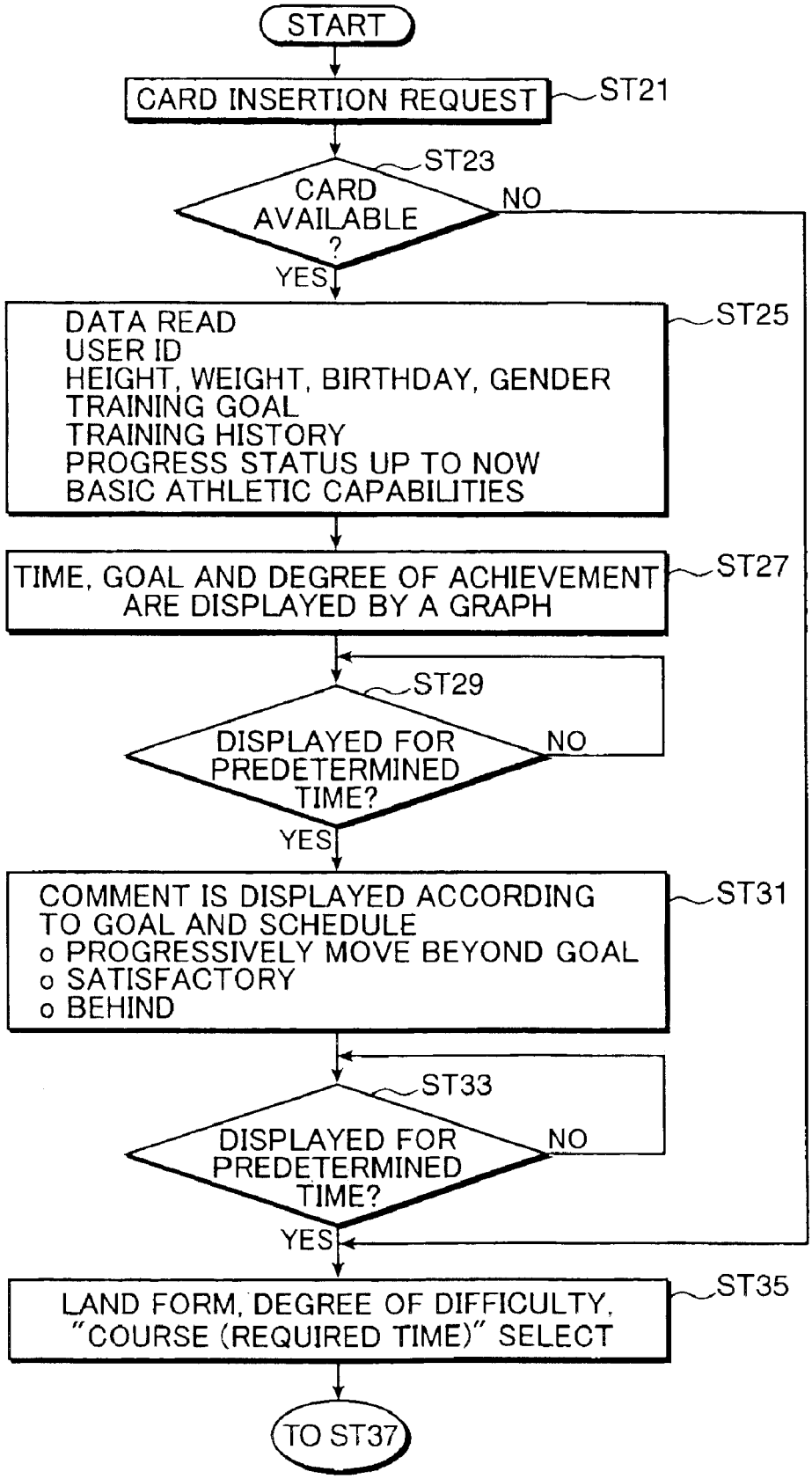
FIGS. 12A and 12B are main flow charts depicting the procedure of exercise support.
Figure 12B:
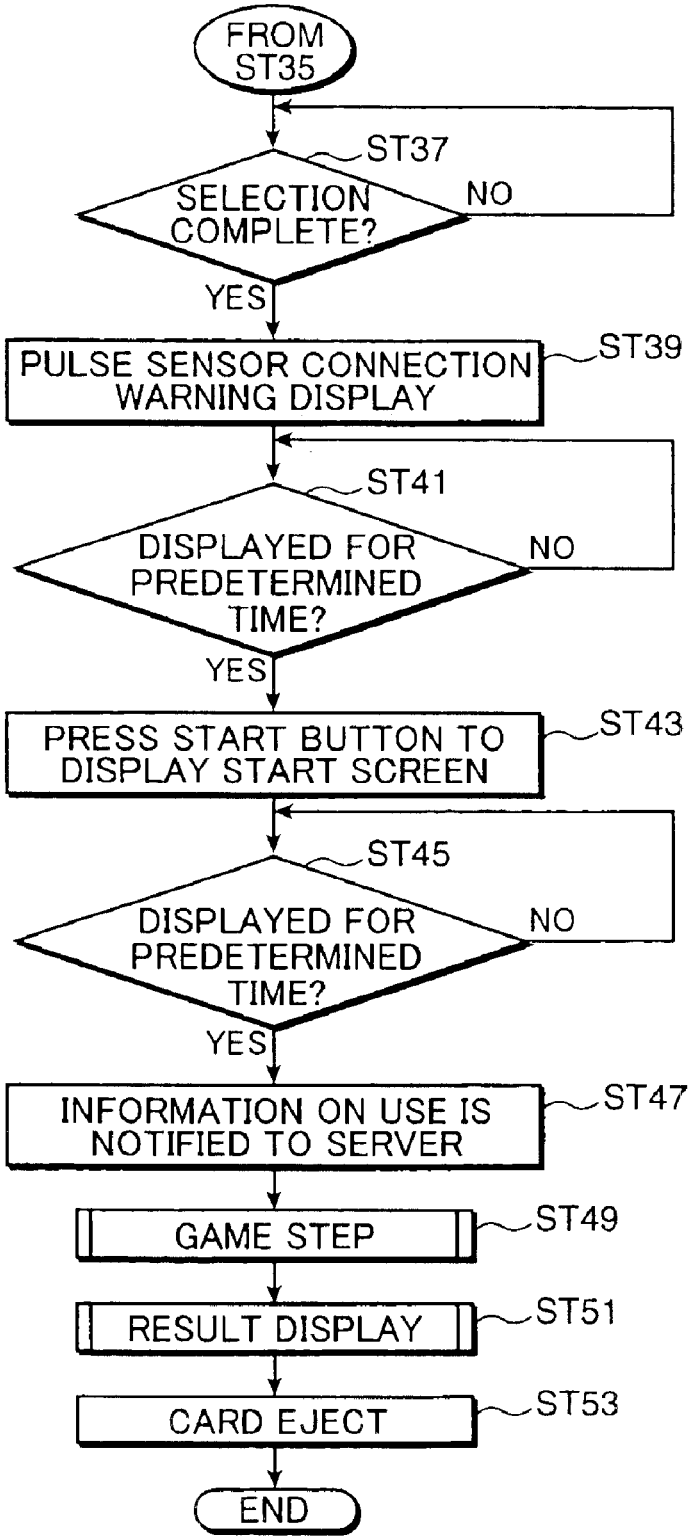

FIGS. 12A and 12B are main flow charts. When power is turned ON, the cycling machine starts up and initialization processing is executed first, then a screen prompting to insert the card is displayed (step ST21), and when the personal card 18 is inserted into the card reader 18*a* (YES in step ST23), the personal data is read from the personal card 18, and a various data input guide screen is displayed after the guide screen shown in FIG. 4–FIG. 5 (step ST25). Various data includes user ID, height, weight, birthday, training goal (course), training history, progress status up to the present, and basic athletic capabilities value, by which the execution of the calculation of consumed calories is insured, and the history information up to the present for the goal is obtained.

When various data is input, the exercise time which has been sent thus far (total value if a plurality of types of exercise equipment are in use), goal (e.g. Kg to be decreased in the case of diet), and the degree of achievement (based on the total value if a plurality of types of exercise equipment are in use) are displayed as a graph (step ST27). This graph is, for example, a line graph where the abscissa is the time and the ordinate is the goal, reflecting the approach to the goal as time passes.

When the above screen is displayed for a predetermined time (step ST29), a comment according to the displayed goal and schedule is displayed (step ST31). The schedule is for showing whether the line graph is the above goal line at the moment (ahead schedule) or not (behind schedule). According to the result, such as message as "Beyond goal", "Satisfactory", and "Behind goal" is displayed. The line graph may be displayed for each exercise equipment.

When the above screen is displayed for a predetermined time (step ST33), a screen to select the goal of today's exercise is displayed, where the input for "Course", "Level" and "Time", shown in FIG. 6, is selected (step ST35).

When the above selection input processing ends (step ST37), a warning (notice) to attach the pulse sensor 19 is displayed (step ST39).

When the above screen is displayed for a predetermined time (step ST41), pressing of the start button shown in FIG. 7 is prompted, and when the start button is pressed, the start display is executed (step ST43), and after the start display is displayed for a predetermined time (step ST45), predetermined points are subtracted from the personal card 18, which is a prepaid card, and information on use is notified from the network communication section 7 to the management server (step ST47). For payment of charges, various methods other than this system, such as cash payment or monthly payment, may be used. The above personal card, of course, need not be a prepaid card. If use is not charged for each time, then a card where personal information is simply input can be used.

Then processing advances to the game step (step ST49), the result is displayed (step ST51), then after the card is ejected (step ST53) this flow is completed.

Figure 13A:
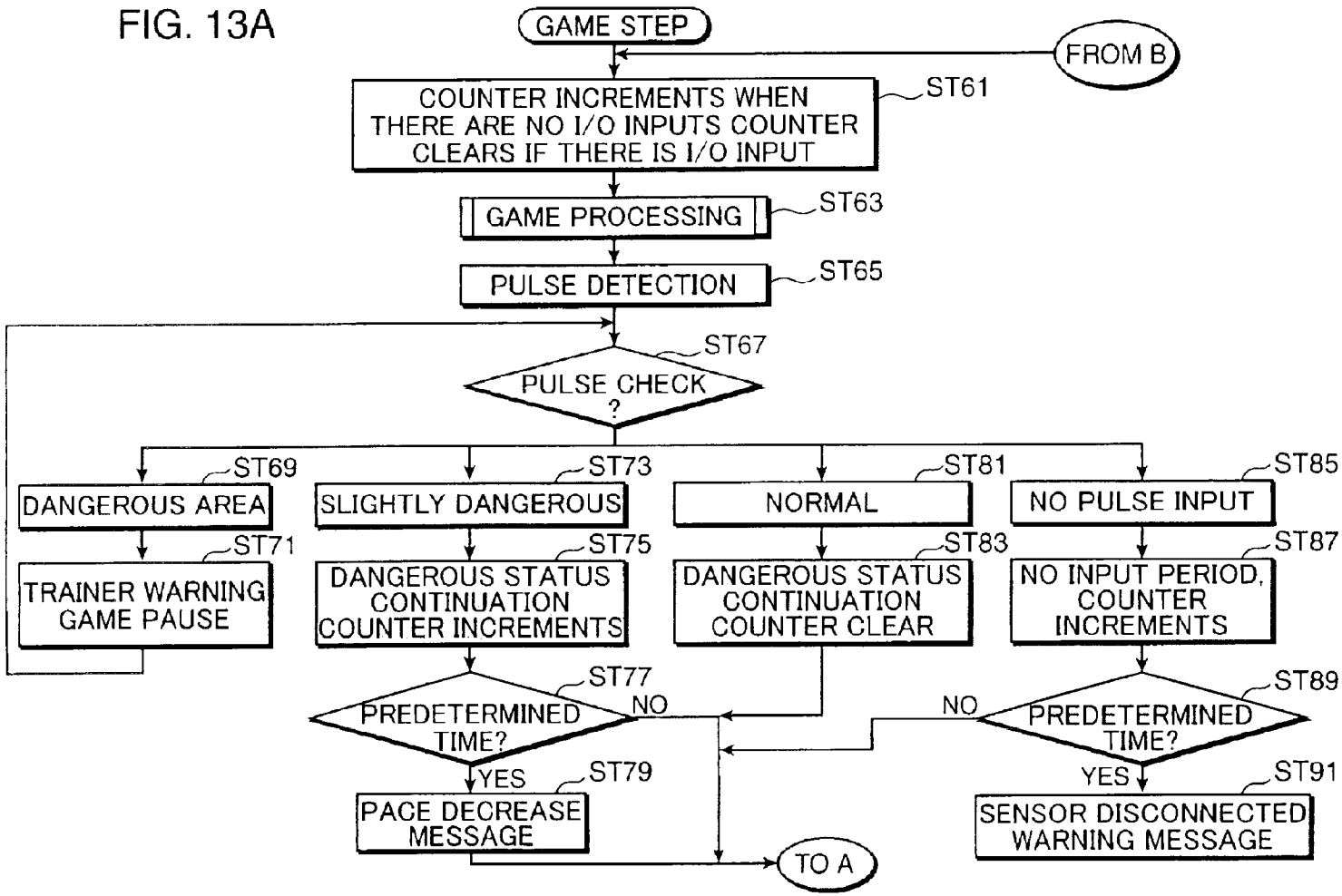
FIGS. 13A and 13B are flow charts depicting "Game Step" processing.
Figure 13B:
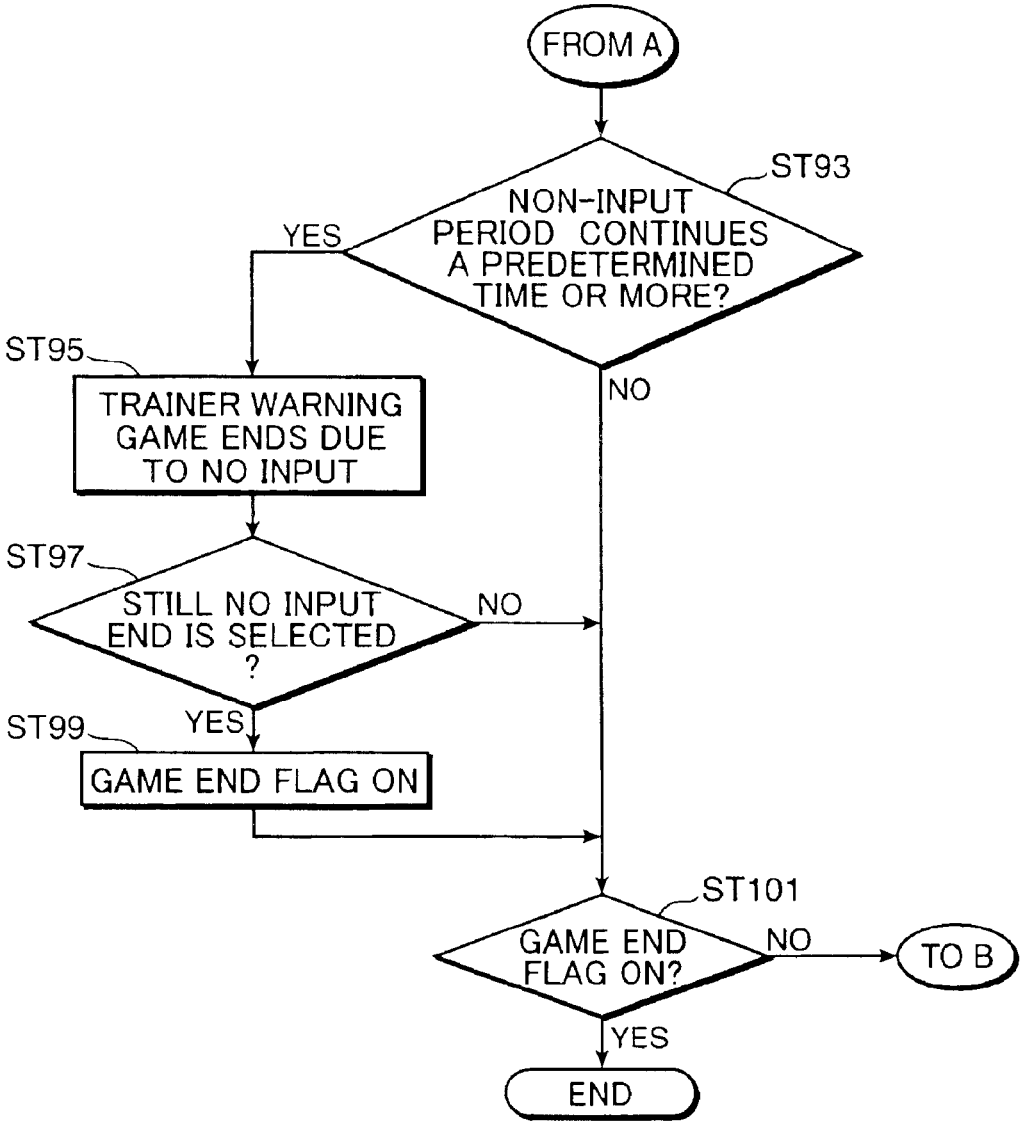

FIGS. 13A and 13B are flow charts depicting "Game Step" processing. At first, processing to clear the count is executed for previous pulse input of the pulse sensor timer if any (step ST61), then game processing is executed (step ST63), and pulse count detection processing is executed by the pulse monitoring section 33 (step ST65). And the detected pulse rate is checked against the target pulse rate (step ST67). In other words, if the detected pulse rate exceeds the upper limit threshold which has been set as the dangerous area (step ST69), the warning message "Game Pause" is displayed on the monitor 14, the brake load setting section 372 sets the brake load amount of the electromagnetic clutch 12*b* to no load in order to idle the pedals 11*b*, and pauses the game (step ST71). When a pulse rate is not input (step ST85), the pulse sensor timer is incremented by "1" (step ST87), then it is judged whether the pulse sensor timer has passed a predetermined time (step ST89), and if the timer is within a predetermined time, processing moves to step ST93, whereas if exceeded, a warning message notifying that the pulse sensor 19 is disconnected is displayed (step ST91).

On the other hand, it is judged whether the detected pulse rate is in a slightly dangerous area, which is somewhat above the target (step ST73), or is normal (roughly matching the target) (step ST81). The exercise equipment control section 37 increments the pulse sensor timer by "1" if the detected pulse rate is in a slightly dangerous area (step ST75), and when a predetermined time has elapsed (step ST77), the exercise equipment control section 37 displays a message to notify a pace reduction via the image display means, and if the detected pulse rate is normal (roughly matching with the target), the exercise equipment control section 37 clears the count of the pulse sensor timer (step ST83), and processing moves to step ST93.

In step ST93, it is judged whether the input from the rotation sensor 11*c* has not been input continuously for a predetermined time due to such a cause as the user not being in attendance or due to an interruption, and if the predetermined time has not elapsed, it is judged whether a game flag is ON (step ST101), and if ON, processing ends, and if not ON, processing returns to step ST61. If the predetermined time has elapsed, a trainer warning is displayed on the monitor 14, and a message asking whether the user wants to end the game, since nothing was input, is displayed (step ST97), and if input is still not detected, even if the setting time has elapsed, or if end is selected, the exercise end flag is turned ON (step ST99), and this flow is exited.

Figure 14:
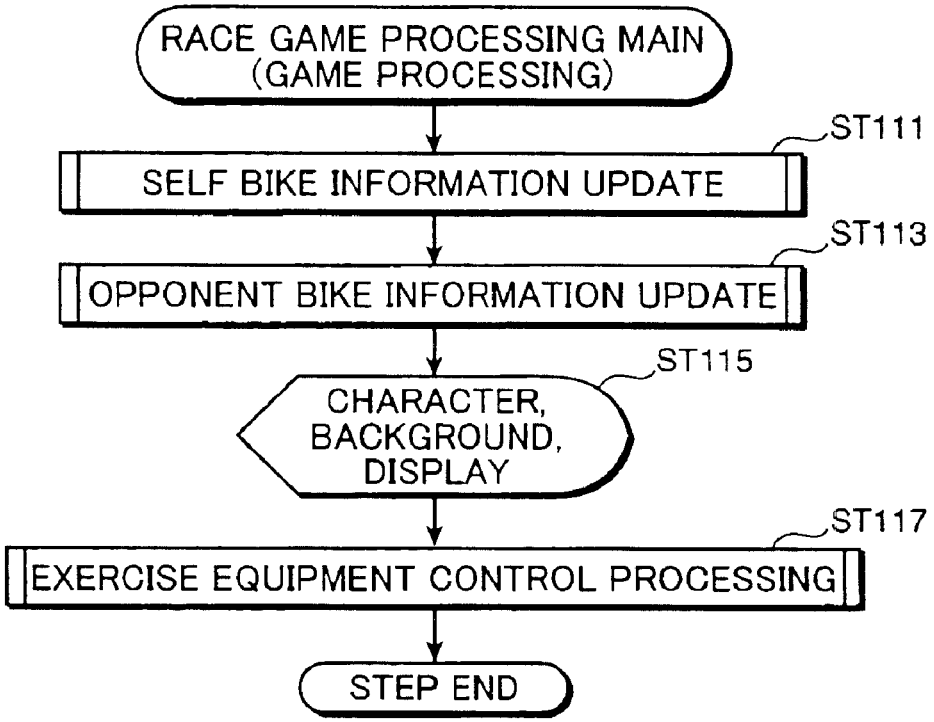
FIG. 14 is a flow chart depicting game processing.

FIG. 14 is a flow chart depicting "Game Processing". At first, self bike information update processing is executed (step ST111), then opponent bike information update processing is executed (step ST113), character and background are displayed (step ST115), exercise equipment control processing is executed (step ST117), then processing ends.

Figure 15:
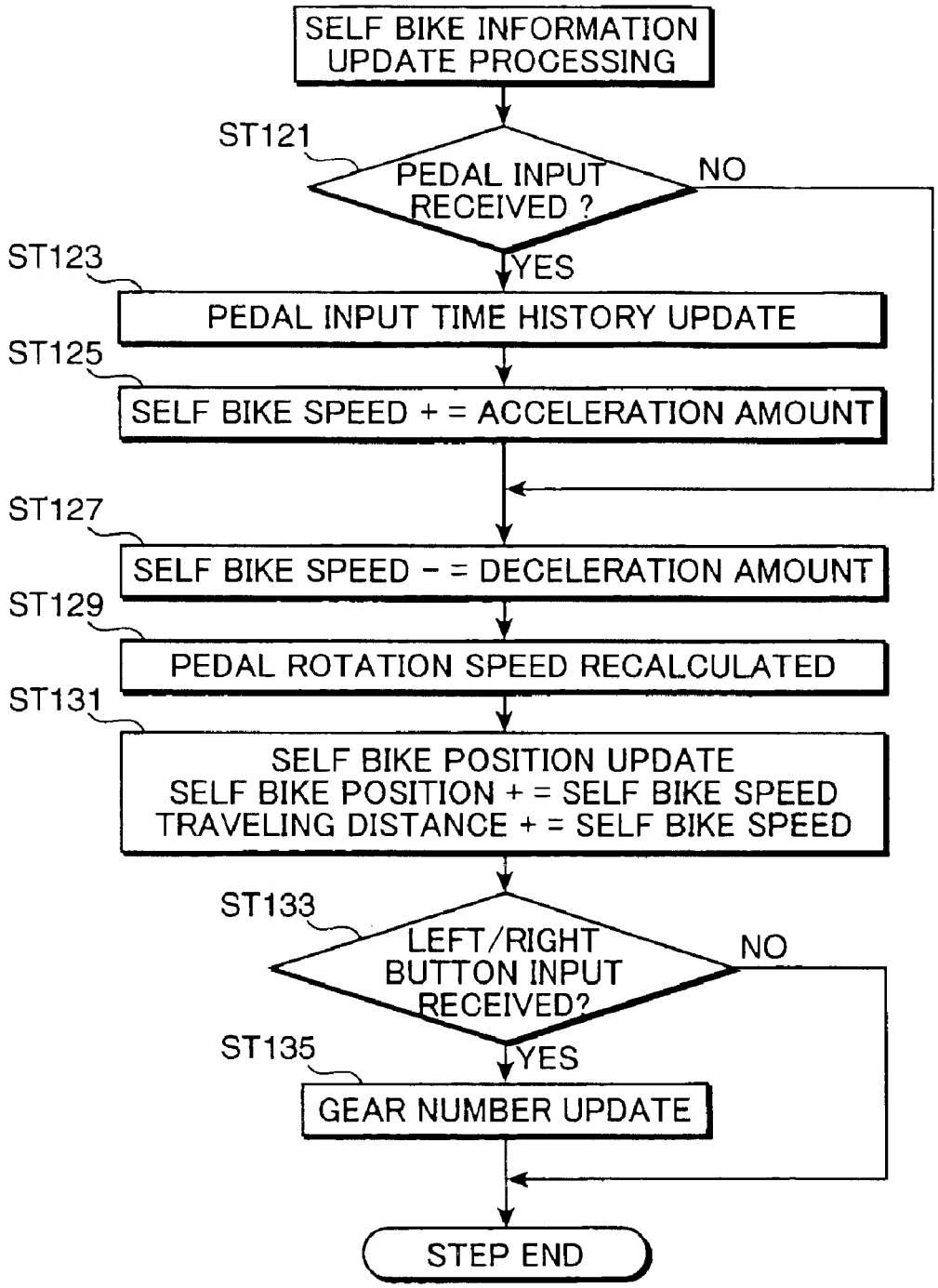
FIG. 15 is a flow chart depicting self bike information update processing.

FIG. 15 is a flow chart depicting "self bike information update processing". At first, whether there is pedal input is judged based on the rotation signal input from the rotation sensor 11*c* (step ST121), and if there is, pedal input time history is updated (step ST123), the self bike acceleration amount is calculated based on the time difference between previous pedal input and this pedal input, and the self bike acceleration table (step ST125), then the rotation speed deceleration amount (friction) is subtracted, and the pedal rotation speed (traveling speed of the simulated cycling machine) is calculated (steps ST127, ST129). If there is no pedal input, on the other hand, the self bike speed deceleration amount is calculated, and the pedal rotation speed is calculated (step ST129). Then the self bike position and the traveling distance are updated based on the pedal rotation speed (step ST131). If there is input from the buttons 17*a* and 17*b* at the left and right after this (step ST133), the gear number is updated (incremented/decremented) based on the input signal, and processing ends (step ST135), and if there is no input, processing ends as is.

Figure 16A:
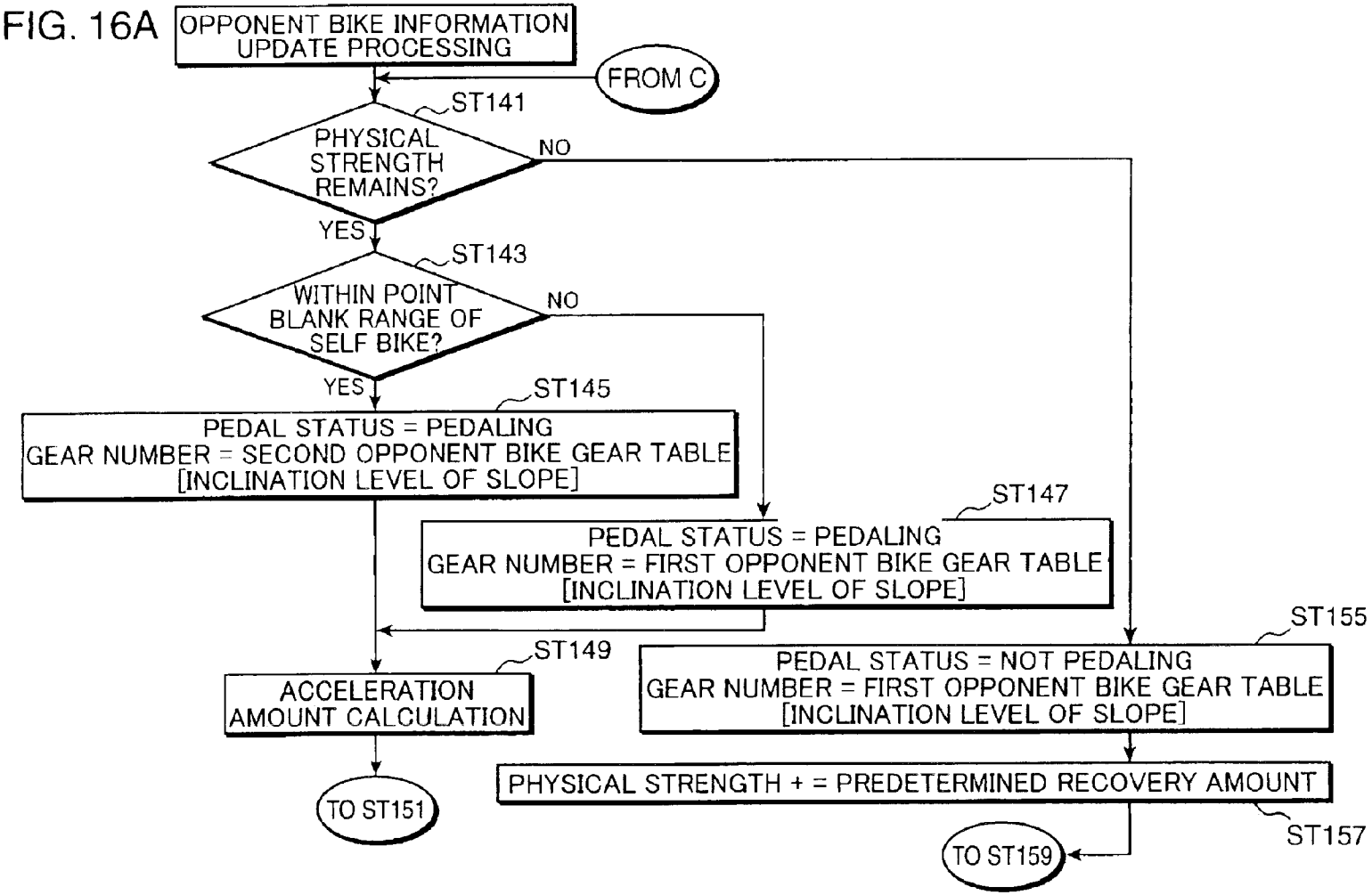
FIGS. 16A and 16B are flow charts depicting opponent bike information update processing.
Figure 16B:
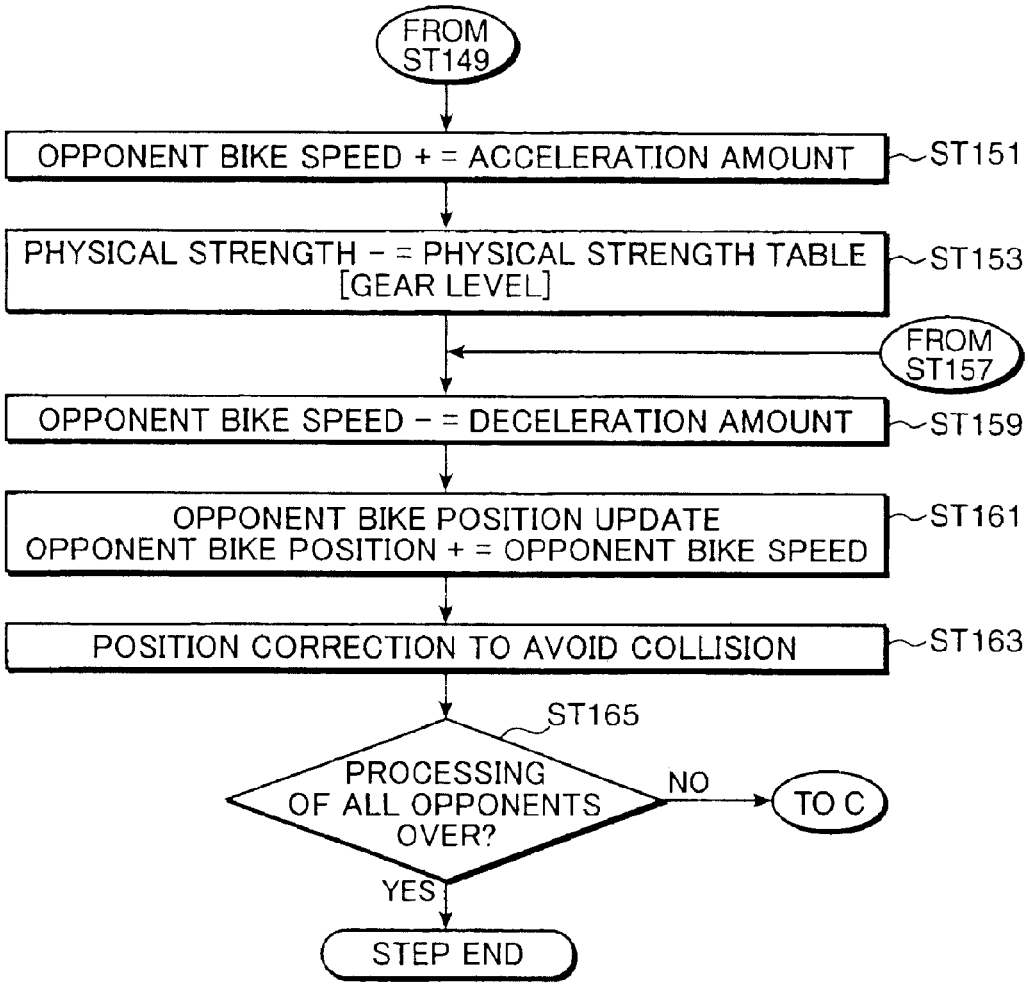

FIGS. 16A and 16B are flow charts depicting "opponent vehicle information update processing". At first, the physical strength calculation section 364 judges whether the physical strength remains for all the opponent characters 105 (step ST141), and for the opponents for whom physical strength remains, the distance detection section 365 judges whether the opponents are within point blank range of the self bike (step ST143). And if an opponent is in point blank range, the pedaling judgment section 361 outputs a display signal for the opponent characters 105, in point blank range, to pedal, regardless the gear number, to the drawing instruction section 31, and sets the gear number to a value based on the second opponent bike gear table. If an opponent is not within point blank range, on the other hand, the pedaling judgment section 361 outputs a display signal to pedal to the drawing instruction section 31, and sets the gear number to a value based on the first opponent bike gear table.

Then the acceleration amount is calculated based on the opponent bike acceleration amount table (step ST149), and the opponent bike speed, that is the moving speed of the opponent character 105, is determined (step ST151), and physical strength is decreased based on the physical strength table (step ST153). At this time, as described above, the physical strength calculation section 364 changes the physical strength decrease value of the opponent character 105, which is a target to pass in point blank range, to a larger physical strength decrease value, so as to further decrease physical strength. By this, the level length of the physical strength 106*a*–108*a* of the head characters 106–108 in point blank range shown in FIG. 8 is decreased. When the level length becomes zero, the bicycle of this opponent character 105 is passed by the bicycle of the user. In other words, a screen is displayed such that the bicycle of the opponent character 105 moves backward to be behind the road character 104*a* (front side of screen), and then disappears. Then processing moves to step ST159. If there is no physical strength remaining in step ST141, on the other hand, the pedaling judgment section 361 outputs a display signal not to pedal to the drawing instruction section 31, and sets the gear number to a value based on the first opponent bike gear table (step ST155), so as to recover physical strength for a predetermined amount (step ST157). And the opponent character 105 whose physical strength recovered may pass the self bike from behind.

Then the deceleration amount of the opponent bike speed, that is the moving speed of the opponent character 105 (step ST159), is determined, the opponent bike position, that is the position of the opponent character 105, is updated, the opponent bike position (traveling distance from the start point) is increased (step ST161), and position is corrected to prevent a collision (step ST163), and if processing for all the opponents (opponent characters 105) has been completed, this flow is completed, and if processing for all the opponents has not completed, processing returns to step ST141.

Figure 17:
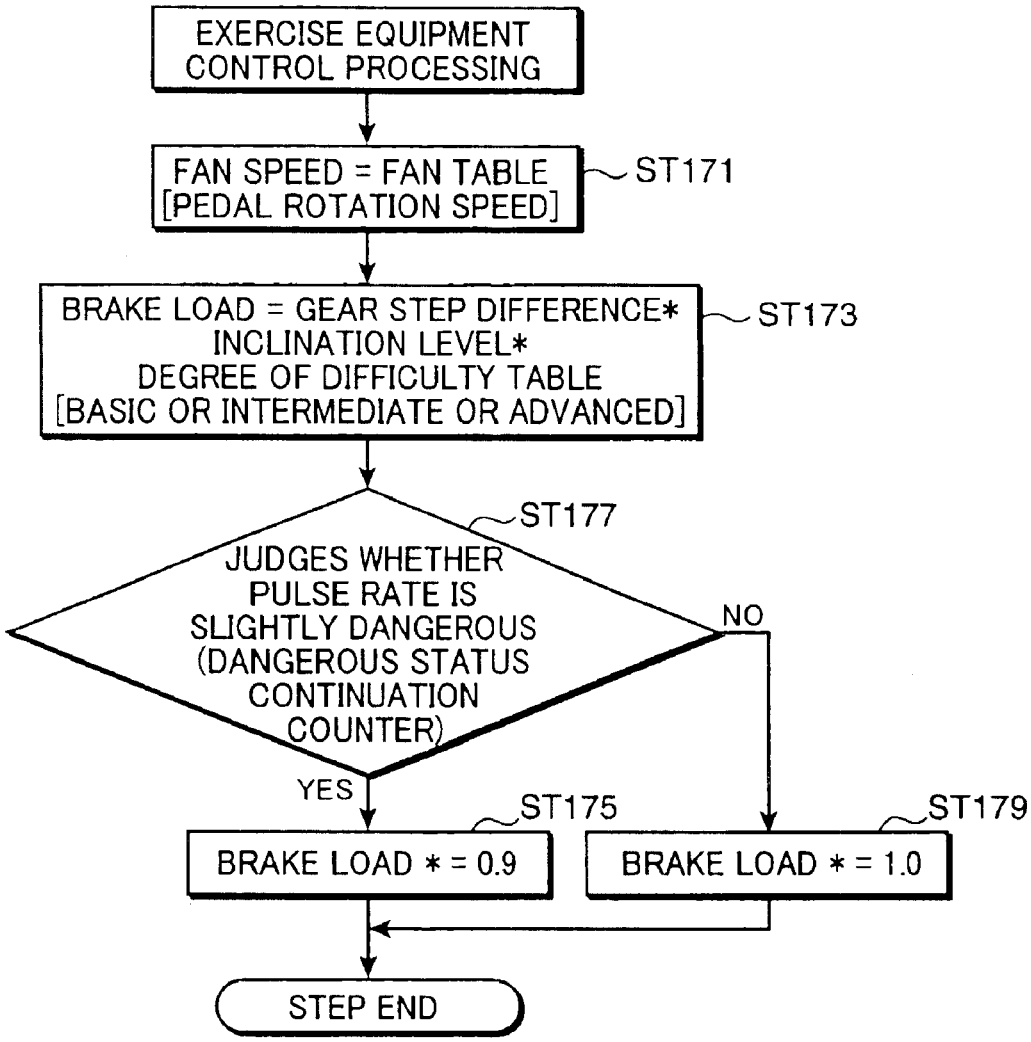
FIG. 17 is a flow chart depicting cycling machine body control processing.

FIG. 17 is a flow chart depicting "exercise equipment control processing". At first, the fan speed is decided based on the pedal rotation speed and fan table to control the rotation of the fan 16 (step ST171), then the brake load setting section 372 determines the brake load amount of the electromagnetic clutch 12*b* (step ST173). The brake load amount is calculated based on the gear number, inclination level, and setting value of the degree of difficulty table, that is an applicable value out of 0.9, 1 and 1.1. Then it is judged whether the pulse rate is slightly dangerous or not based on the counter value of the dangerous status continuation timer (step ST175), and if the pulse rate is slightly dangerous, the brake load amount of the electromagnetic clutch 12*b* is set to 0.9 times (step ST177), and if not, the brake load amount is set to 1 time (step ST179), and this flow is ended.

Figure 18:
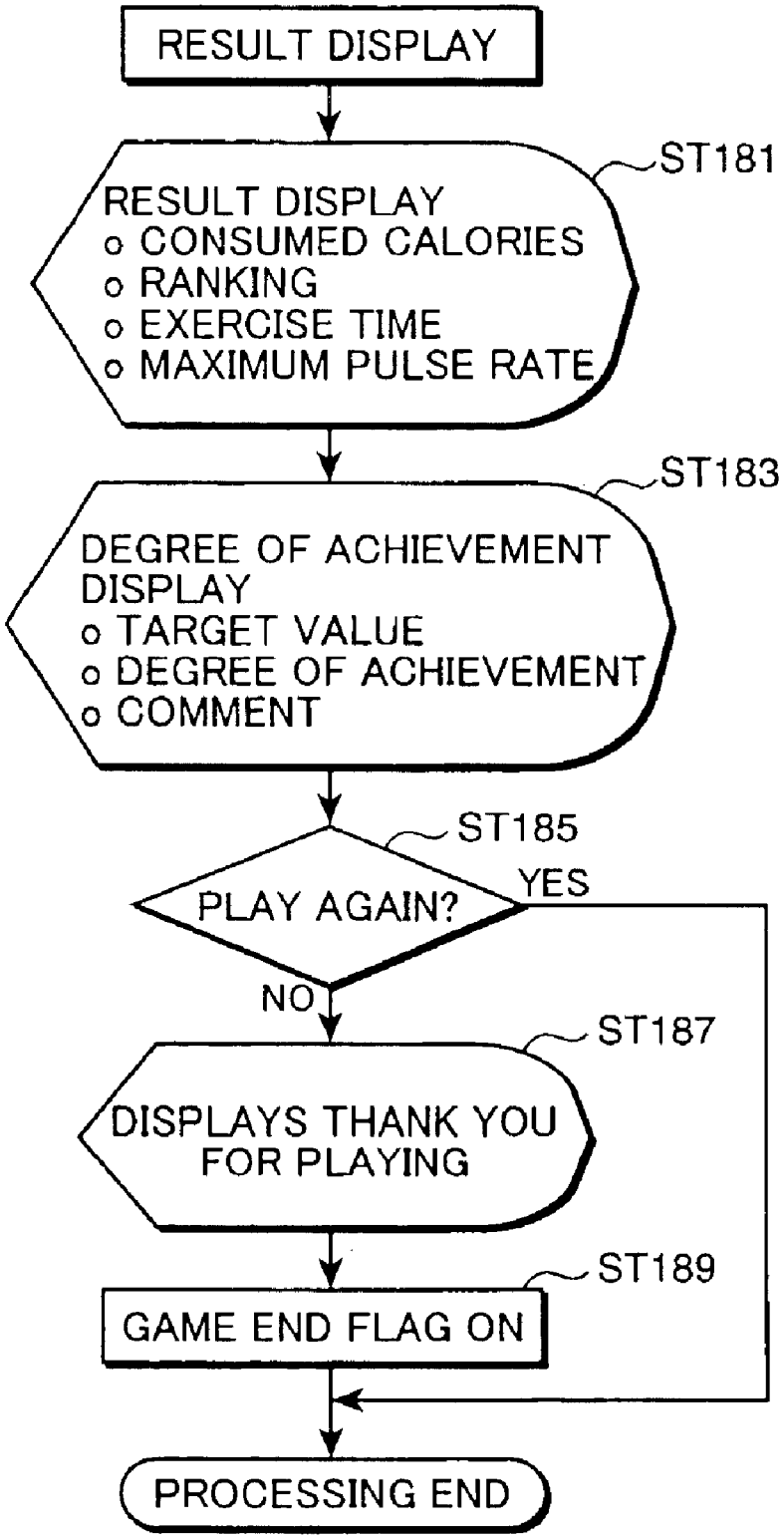
FIG. 18 is a flow chart depicting "Result Display" processing.

FIG. 18 is a flow chart of "result display" processing. At first, as FIG. 9 shows, "total ranking", "consumed calories", "exercise time", "maximum pulse rate", and "your target today" are displayed as a result display (step ST181), then the content of "target value (consumed calories)", "degree of achievement" and "comment" is displayed as the degree of achievement display (step ST183). An example of the content of a comment is "progressing according to goal, keep going" or "a little behind goal, increase the amount of exercise slightly more each time".

Then as FIG. 10 shows, whether to continue play is prompted by "Yes" or "No" (Step ST185), and if "Yes", this flow is exited, and if "No", the exercise end flag is turned ON via the screen in FIG. 11, and this flow is exited (steps ST187, ST189).

Therefore according to the present embodiment, the opponent characters 105, which are traveling, are displayed on the monitor 14, and the physical strength of the opponent characters 105 near the self bike position (degree of difficulty to pass) is displayed as a guide (106*a*, 107*a*, 108*a* in FIG. 8), so the user is highly motivated and has an aroused sense of rivalry by knowing the degree of difficulty to pass an opponent who is in a position where the user can pass, and the user can exhibit an active will to exercise.

In the above mentioned embodiment, the brake load amount of the electromagnetic clutch is substantially adjusted using two tables, that is, the road table where inclination levels are set according to the road character, and the gear table where gear numbers are set based on the inclination level, but the present invention is not limited to this. For example, only the gear table, where the gear numbers are set for the entire length of the road characters, may be used directly.

In the above mentioned embodiment, the gear number is adjusted for six levels, 1–6, according to the inclination level of the slope, but the present invention is not limited to this, and an arbitrary gear number may be set.

In the above mentioned embodiment, the point blank range is set to within 10 meters ahead and behind the self bike position, but the present invention is not limited to this. For example, another arbitrary value may be used for the distance ahead and behind the self vehicle position, or only all or a part of the opponent characters ahead of the self bike position may be the target.

In the above mentioned embodiment, the degree of difficulty to pass (physical strength) is determined based on the distance difference between the self bike position and the traveling position (progressing position) of the opponent character, but the present invention is not limited to this. For example, a degree of difficulty based on the relative difference of the traveling speed between the self bike and the opponent character may be used. As another variation, opponent characters having a large physical strength may be set to predetermined periodic ranking numbers, such as No. 10, No. 20 and No. 30. And the upper body and physical strength of the opponent with this ranking number are displayed on the screen. This allows strong opponents to appear periodically, and allows avoiding cases where an excessive load is applied to the user by a plurality of strong opponents who continuously appear. Also the user can have a goal or the rhythm to pass an opponent with this ranking number, so exercise support can be easily performed.

Also according to the above mentioned embodiment, the physical strength is displayed as a bar type level length as the degree of difficulty to pass, but the present invention is not limited to this, and another method, such as changing the angle of the indicator seen in the speed meter of a vehicle, may be used for display.

Also in the above mentioned embodiment, the brake load amount of the electromagnetic clutch 12*b* is set to no load when the pulse rate is in the dangerous area, but the present invention is not limited to this, for when the pulse rate is in the dangerous area, the brake load may be set to a state close to no load where the game is paused. Noteworthy here is that the user can easily move the movable section so that the user does not experience much load.

FIGS. 19A to 19D are diagrams depicting a configuration of other examples of exercise equipment to which the present invention is applied.

Figure 19A:
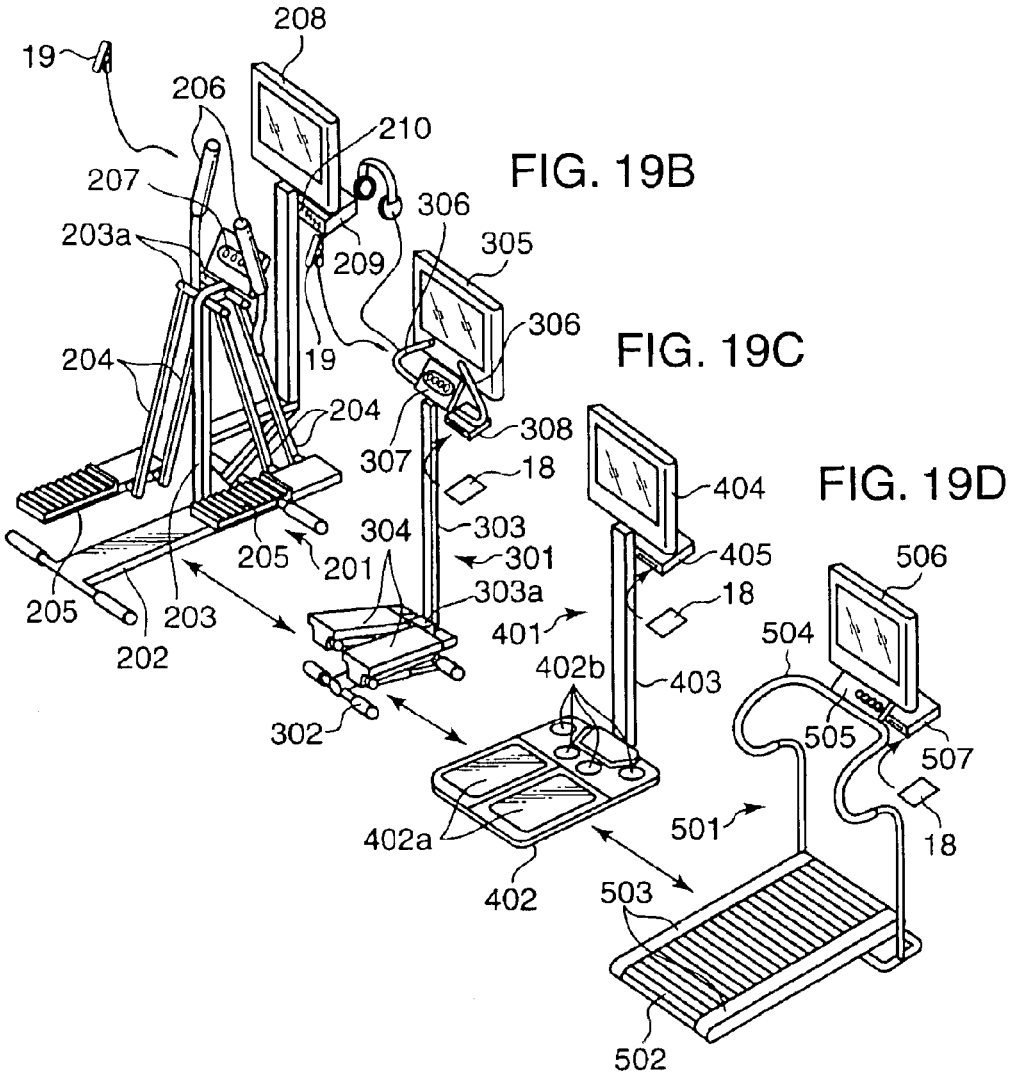

FIG. 19A is an external view depicting a configuration of the walking equipment 201, which has an upright support section 203 at the center, slightly in front of the H-shaped base 202, where the rotary axis 203*a*, which extends in the left and right directions, is supported at the top end of the support section 203, and two swinging arms 204 are vertically installed at the left and right ends, and foot rests 205 are installed on the bottom of the swinging arms 204. Out of the two swinging arms 204, one swinging arm 204 is rotatable with respect to the support section 203, and the other arm is a swinging arm 204 whereby the bottom end is slidable in the horizontal direction with respect to the foot rests 205, so that the left and right foot rests 205 are maintained in a horizontal position, and can alternately slide to the fore and aft in the reverse direction. A grip section 206 is attached to the top end of the left and right swinging arms 204 respectively so as to extend therefrom. The operation panel 207 is installed at the top end of the support section 203, and the monitor 208 is installed in the front of this equipment. At an appropriate location at the lower part of the monitor 208, there is the card reader 209 for a personal card 18 and the entry 210 for the lead wire of the pulse sensor 19. The user places both feet on the foot rests 205, and rotates the swinging arms 204 to the fore and aft directions as if walking. Although not illustrated here, a load change means such as an electromagnetic clutch is installed on the rotary axis 203*a* at the top end of the swinging arms 204, and an adjustment means, corresponding to the buttons 17*a* and 17*b*, for adjusting the load amount of the load change means, are installed, and also an oscillation sensor, such as a rotary encoder, corresponding to the rotation sensor 11*c* in FIG. 1, for detecting that the rotary axis 203*a* rotates forward and backward for a required angle at a respective time, is installed near the load change means. For the configuration of the control side, the control program is substantially the same as the cycling machine in FIG. 1, except that the characteristic difference between the walking machine and the cycling machine is reflected. The role playing characters to be displayed are displayed on the monitor as if performing a walking or running operation.

FIG. 19B is also an external view depicting a configuration of the walking equipment 301, which has an upright support section 303 at the front end of the H-shaped base 302, where the rotary axis 303*a*, which extends in the left and right directions, is supported at the base of the support section 303, and a pair of foot rests 304, which alternately perform a swinging operation in the reverse directions, are installed at the left and right of the rotary axis 303*a*. At the top end of the support section, the monitor 305 is installed, and grip sections 306 are also installed. The operation panel 307 is installed near the top end of the support section 303. At an appropriate location at the lower part of the operation panel 307, there is the card reader 308 of a personal card 18, and the entry of the lead wire of the pulse sensor 19 (not illustrated in the drawing). The user places both feet on the foot rests 304 and pedals up and down as if walking. Although not illustrated here, a load changing means, such as an electromagnetic clutch, is installed on the rotary axis 303*a*, and an adjustment means, corresponding to the buttons 17*a* and 17*b*, for adjusting the load amount of the load change means, are also installed, and also an oscillation sensor, such as a rotary encoder, corresponding to the rotation sensor 11*c* in FIG. 1, for detecting that the rotary axis 303*a* rotates forward and backward for a required angle each time, is installed near the load change means. For the configuration of the control side, the control program is substantially the same as the cycling machine in FIG. 1, except that the characteristic difference between the walking machine and the cycling machine is reflected. The role playing characters to be displayed on the monitor are displayed as if performing a walking or running operation.

FIG. 19C is also an external view depicting a configuration of the walking equipment 401, which has a mat type base plate 402 and an upright support section 403 at the front end thereof, where the monitor 404, card reader 405 of a personal card 18, and the entry of the lead wire of the pulse sensor 19 (not illustrated in the drawing) are installed at the top end of the support section 303. On the base plate 402, marks 402*a*, to indicate the stepping area at the left and right, are created, under which switches for detecting the pressing status by gravitational force are embedded. In front of the marks 402*a*, marks 402*b*, corresponding to each button of the operation panel, are created, under which switches are embedded. This equipment has no load change means or adjustment means corresponding to the buttons 17*a* and 17*b*. For the configuration of the control side, the control program is substantially the same as the cycling machine in FIG. 1, except that the characteristic difference between the walking machine and the cycling machine is reflected, and load change is not changed. The role playing characters to be displayed on the monitor are displayed as if performing a walking or running operation.

FIG. 19D is also an external view depicting a configuration of the walking equipment 501, where a rotatable looped belt 502, which inclines downward toward the back, is supported by the left and right guides 503 so that the belt can rotate. At the front end of the looped belt 502, a grip section 504 is installed in a shape which crosses over the front side of the looped belt 502, and the operation panel 505, monitor 506, card reader 507 of the personal card 18, and the entry of the lead wire of the pulsing sensor 19 (not illustrated in the drawing) are installed on the top of the grip section 504. Although not illustrated here, a load change means, such as an electromagnetic clutch, for variably changing the load of the rotating operation of the looped belt 502, is installed at an appropriate location between the guides 503 on both sides, and an adjustment means, corresponding to the buttons 17*a* and 17*b*, for adjusting the load amount of the load change means, are also installed, and also a movement amount detection sensor, corresponding to the rotation sensor 11*c* in FIG. 1, for detecting the rotation amount of the looped belt 502, is installed at an appropriate location between the guides 503 on both sides. For the configuration of the control side, the control program is substantially the same as the cycling machine in FIG. 1, except that the characteristic difference between the walking machine and the cycling machine is reflected. The role playing characters to be displayed on the monitor are displayed as if performing a walking or running operation.

The present invention can also be applied to exercise equipment for endurance competition, such as equipment to row a boat where the load amount of oars can be variable.

In summary, the present invention relates to an exercise assistance apparatus which has an exercise equipment where a movable section for a user to perform a traveling movement operation in a loaded status and a detection section for detecting the movement of the movable section are disposed, said exercise assistance apparatus comprising: a monitor for displaying images which is installed at the front side of the exercise equipment, storage means for storing at least image data to express a traveling path and a predetermined number of opponent characters to be displayed on the traveling path, exercise equipment control means for performing variable control for the load status of the exercise equipment, opponent traveling control means for controlling the traveling positions of the predetermined number of opponent characters on the traveling path with sequential updating, self position calculation means for calculating a virtual self position of the user on the traveling path from the detection content of the detection section and the load status controlled by the exercise equipment control means, and image display means for displaying the traveling path ahead of the self position and opponent characters at an updated traveling position on the traveling path ahead of the self position, and displaying the degree of difficulty to pass the opponent character.

According to the present invention, opponent characters traveling with the exercise equipment character are displayed on the monitor by the image display means, and the degree of difficulty to pass the opponent is displayed, so the user is highly motivated and arouses a sense of rivalry by knowing the degree of difficulty to pass an opponent who is in a position where the user can pass, and the user can exhibit an active will to exercise.

Here it is preferable that the degree of difficulty to pass to be displayed is updated at a predetermined time pitch or variable pitch based on, for example, the relative difference between the self position and traveling position of the opponent character, or the relative difference between the detection content (e.g. traveling speed) of the detection section and the traveling speed of the opponent character.

The aforementioned invention is preferably characterized in that the exercise equipment further comprises load change means for performing variable control for the load status, and the exercise equipment control means adjusts the load amount of the load change means.

With the aforementioned features, the load change means of the exercise equipment performs variable control on the load status, so various exercises can be set. For example, if inclination information is set for the traveling path, and the exercise equipment control means adjusts the load amount of the load change means according to the inclination information, then not only a flat traveling path but exercise, including moving up and down, can be set.

The present invention can be further characterized in that the exercise equipment has adjustment means for adjusting the load amount of the load change means from the outside.

With the above-described features, the user can arbitrarily adjust the load amount of the load change means, not just adjusting the load amount of the load change means at the exercise equipment side. For example, if the exercise equipment is a fixed type cycling machine comprising pedals as a movable section and a detection section for detecting the pedal rotation frequency as in the invention in claim 5, and the self position calculation means is for determining the traveling position based on the detected pedal rotation frequency of the detection section, then it is preferable to set such that when the adjustment means adjusts the load amount of the load change means to high, the traveling speed becomes fast (traveling distance becomes long) if the user pedals at a rotation frequency similar to the rotation frequency used thus far, and when the load amount of the load change means is adjusted to low, the traveling speed becomes slow (traveling distance becomes short) if the user pedals at a rotation frequency similar to the rotation frequency used thus far. By such a setting, a bicycle, of which the transmission gears can actually be changed, can be operated as if the user is pedaling with changing gears, and the active will of the user to exercise can be further exhibited.

In addition, the present invention preferably comprises a sensor for detecting the pulse rate of the user, wherein the exercise equipment control means adjusts the load amount of the load change means based on the pulse rate detected by the sensor.

According to this invention with the above-described features, the load amount of the load change means is adjusted if the pulse rate of the user is high. If the load amount of the load change means is adjusted to no load or to a low load which is very close to no load at this time, the user can easily move the movable section, and the user does not experience much load.

Moreover, the present invention further comprises evaluation means for evaluating such that the user advances in ranking when the user passes an opponent character.

According to this invention with the aforementioned features, the user advances in ranking if the user passes an opponent character, so the active will of the user to the exercise can be further exhibited.

This application is based on Japanese patent application serial no. 2002-4679, filed in Japan Patent Office on Jan. 11, 2002, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An exercise assistance apparatus which has an exercise equipment provided with a movable section for a user to perform a moving operation in a loaded state and a detection section for detecting the movement of the movable section, said exercise assistance apparatus comprising:

a monitor for displaying images which is installed at the front side of said exercise equipment;

storage means for storing at least image data to express a traveling path and a predetermined number of opponent characters to be displayed on said traveling path, and the data regarding movement of an opponent character in association with a road data from a start point to a goal point;

exercise equipment control means for performing variable control for the load status of said exercise equipment;

opponent movement control means for controlling the traveling positions of said predetermined number of opponent characters on said traveling path with sequential updating, in accordance with the movement data of the opponent character stored in the storage means;

self position calculation means for calculating a virtual self position of the user on said traveling path from the detection content of said detection section and the load status controlled by the exercise equipment control means; and image display means for displaying the traveling path ahead of said self position and opponent characters at an updated traveling position on said traveling path ahead of the self position, and displaying the degree of difficulty to pass said opponent character.

2. The exercise assistance apparatus according to claim 1, wherein said opponent movement control means updates the degree of difficulty to pass at a predetermined time period based on the relative difference between the self position and traveling position of the opponent character.

3. The exercise assistance apparatus according to claim 1, wherein said opponent movement control means updates the degree of difficulty to pass at a predetermined time period based on the relative difference between the traveling speed detected by said detection section and the traveling speed of the opponent character.

4. The exercise assistance apparatus according to claim 1, wherein said exercise equipment further comprising load change means for performing variable control for a status of the load, and said exercise equipment control means adjusts the load amount of the load change means.

5. The exercise assistance apparatus according to claim 4, wherein the inclination information is set for said traveling path, and said exercise equipment control means adjusts the load amount of the load change means according to the inclination information.

6. The exercise assistance apparatus according to claim 4, wherein said exercise equipment has adjustment means for adjusting the load amount of said load change means from the outside.

7. The exercise assistance apparatus according to claim 1, wherein said exercise equipment is a fixed type cycling machine comprising pedals as a movable section and a detection section for detecting the pedal rotation frequency, and said self position calculation means is for determining the traveling position based on the detected pedal rotation frequency of the detection section.

8. The exercise assistance apparatus according to claim 1, further comprising a sensor for detecting the pulse rate of said user, wherein said exercise equipment control means adjusts the load amount of the load change means based on the pulse rate detected by said sensor.

9. The exercise assistance apparatus according to claim 1, further comprising evaluation means for evaluating the moving operation of the user in such a manner that said user advances in rank when the user passes an opponent character.

10. The exercise assistance apparatus according to claim 1, wherein said road data is stored in a road table which is stored in said storage means and an inclination level is set in the road table according to a position from the start point to the goal point, said storage means stores an opponent bike table and the moving speed of said opponent character is set in the opponent bike table where said moving speed in relation to said inclination level is set.

11. The exercise assistance apparatus according to claim 10, wherein said storage means stores a physical strength table provided for each of the opponent characters for storing the data relating to the physical strength for each of the opponent characters.

12. The exercise assistance apparatus according to claim 11, further comprising a physical strength calculation section for calculating the physical strength of the opponent character based on said data relating to the physical strength and a pedaling judgment section for judging if the opponent character is pedaling or not and the physical strength value for the opponent character found to be not pedaling, is increased.

13. The exercise assistance apparatus according to claim 11, further comprising a physical strength calculation section for calculating the physical strength of the opponent character based on said data relating to the physical strength and a pedaling judgment section for judging if the opponent character is pedaling or not and the physical strength value for the opponent character, found to be pedaling, is decreased.

14. The exercise assistance apparatus according to claim 11, further comprising a pedaling judgment section for judging if the opponent character is pedaling or not and a physical strength calculation section which calculates the physical strength of the opponent character based on the judgment result of the pedaling judgment section.

15. The exercise assistance apparatus according to claim 14, wherein the physical strength value for the opponent character who is in a point blank range with respect to the virtual self position of the user is displayed on the monitor as the degree of difficulty to pass.

16. The exercise assistance apparatus according to claim 14, further comprising a distance detection section for determining a distance between the position of the opponent character and the self position.

17. The exercise assistance apparatus according to claim 16, wherein said distance detection section specifies the opponent characters that are in a predetermined region with respect to the self position of the user based on the distances determined by the distance detection section.

18. The exercise assistance apparatus according to claim 17, wherein the physical strength values for the opponent characters that were found to be within the predetermined region are displayed on the monitor and said strength value is an indicia for the degree of the difficulty to pass.

* * * * *